US007110011B2

(12) United States Patent
Yamaguchi et al.

(10) Patent No.: US 7,110,011 B2
(45) Date of Patent: Sep. 19, 2006

(54) MONOCHROMATIC IMAGE DISPLAY SYSTEM

(75) Inventors: Akira Yamaguchi, Kanagawa-ken (JP); Eiji Ogawa, Kanagawa-ken (JP)

(73) Assignee: Fuji Photo Film Co., Ltd., Kanagawa-ken (JP)

( * ) Notice: Subject to any disclaimer, the term of this patent is extended or adjusted under 35 U.S.C. 154(b) by 59 days.

(21) Appl. No.: 09/289,600

(22) Filed: Apr. 12, 1999

(65) Prior Publication Data

US 2003/0151573 A1 Aug. 14, 2003

(30) Foreign Application Priority Data

Apr. 10, 1998 (JP) ..... 10-098991
Apr. 30, 1998 (JP) ..... 10-119827
Apr. 30, 1998 (JP) ..... 10-119828

(51) Int. Cl.
*G09G 5/02* (2006.01)

(52) U.S. Cl. ..... 345/694; 345/89; 345/90

(58) Field of Classification Search ..... 345/149, 345/89, 147, 152, 599, 90, 613, 694, 690, 345/103, 695, 698, 696, 697
See application file for complete search history.

(56) References Cited

U.S. PATENT DOCUMENTS 5,483,634 A * 1/1996 Hasegawa ..... 345/501
5,543,819 A * 8/1996 Farwell et al. ..... 345/694
5,739,808 A * 4/1998 Suga et al. ..... 345/89
5,748,164 A * 5/1998 Handschy ..... 345/89
5,872,554 A * 2/1999 Chang et al. ..... 345/147
5,917,621 A * 6/1999 Yushiya ..... 358/518
6,018,237 A * 1/2000 Havel ..... 324/115
6,091,396 A * 7/2000 Minami et al. ..... 345/147
6,128,000 A * 10/2000 Jouppi et al. ..... 345/136
6,278,434 B1 * 8/2001 Hill et al. ..... 345/127
6,326,726 B1 * 12/2001 Mizutani et al. ..... 313/504

FOREIGN PATENT DOCUMENTS

JP 62-18536 1/1987

OTHER PUBLICATIONS

Foley et al. "Computer Graphics Principles and Practice" 2nd edition , Addition-Wesldy Publishing Co., Dec. 1990.*
Denshi Gijutsu, extra edition, May (vol. 32, No. 7) pp. 110-121.

* cited by examiner

*Primary Examiner*—Richard Hjerpe
*Assistant Examiner*—Jean Lesperance
(74) *Attorney, Agent, or Firm*—Sughrue Mion, PLLC

(57) ABSTRACT

In a monochromatic image display system, the number of tone levels which can be expressed is multiplied. As a display device, a liquid crystal panel 40 which can express each picture element 41 of a monochromatic image by three cells 41*a*, 41*b* and 41*c* is employed. A tone number conversion processing means 20 carries out a tone number conversion processing on an input original image signal Sorig according to the maximum number of tone levels which can be expressed by the liquid crystal panel 40, thereby obtaining a monochromatic image signal So. Luminance of the monochromatic image signal So is allotted to the cells 41*a*, 41*b* and 41*c*. Time modulation is carried out on each cell by a time modulation means 12 which can express four tone levels (but tone level 0) so that each cell outputs allotted luminance. In this manner, the liquid crystal panel 40 can express thirteen tone levels (4×3+1=13) in total (tone level 0 inclusive).

34 Claims, 23 Drawing Sheets

| TONE LEVEL | 104a | 104b | |
|---|---|---|---|
| 0 | 0 | 0 | 104a+ 0×64 (104b) |
| 1 | 1 | 0 | |
| 2 | 2 | 0 | |
| 3 | 3 | 0 | |
| 4 | 4 | 0 | |
| ⋮ | ⋮ | ⋮ | |
| 62 | 62 | 0 | |
| 63 | 63 | 0 | |
| 64 | 0 | 1 | 104a+ 1×64 (104b) |
| 65 | 1 | 1 | |
| 66 | 1 | 1 | |
| ⋮ | ⋮ | ⋮ | |
| 126 | 62 | 1 | |
| 127 | 63 | 1 | |
| 128 | 0 | 2 | ⋮ |
| 129 | 1 | 2 | |
| 130 | 2 | 2 | |
| ⋮ | ⋮ | ⋮ | |
| 4030 | 62 | 62 | |
| 4031 | 63 | 62 | |
| 4032 | 0 | 63 | 104a+ 63×64 (104b) |
| 4033 | 1 | 63 | |
| 4034 | 2 | 63 | |
| ⋮ | ⋮ | ⋮ | |
| 4093 | 61 | 63 | |
| 4094 | 62 | 63 | |
| 4095 | 63 | 63 | |

| TONE LEVEL | 41a | 41b | 41c |
|---|---|---|---|
| 0 | 0 | 0 | 0 |
| 1 | 1 | 0 | 0 |
| 2 | 1 | 0 | 1 |
| 3 | 2 | 0 | 1 |
| 4 | 2 | 0 | 2 |
| ⋮ | ⋮ | ⋮ | |
| 62 | 31 | 0 | 31 |
| 63 | 32 | 0 | 31 |
| 64 | 0 | 1 | 0 |
| 65 | 1 | 1 | 0 |
| 66 | 1 | 1 | 1 |
| ⋮ | ⋮ | ⋮ | |
| 126 | 31 | 1 | 31 |
| 127 | 32 | 1 | 31 |
| 128 | 0 | 2 | 0 |
| 129 | 1 | 2 | 0 |
| 130 | 1 | 2 | 1 |
| ⋮ | ⋮ | ⋮ | |
| 4030 | 31 | 62 | 31 |
| 4031 | 32 | 62 | 31 |
| 4032 | 0 | 63 | 0 |
| 4033 | 1 | 63 | 0 |
| 4034 | 1 | 63 | 1 |
| ⋮ | ⋮ | ⋮ | |
| 4093 | 31 | 63 | 30 |
| 4094 | 31 | 63 | 31 |
| 4095 | 32 | 63 | 31 |

$141a + \underbrace{0 \times 64}_{141b} + 141c$ $141a + \underbrace{1 \times 64}_{141b} + 141c$ $141a + \underbrace{63 \times 64}_{141b} + 141c$

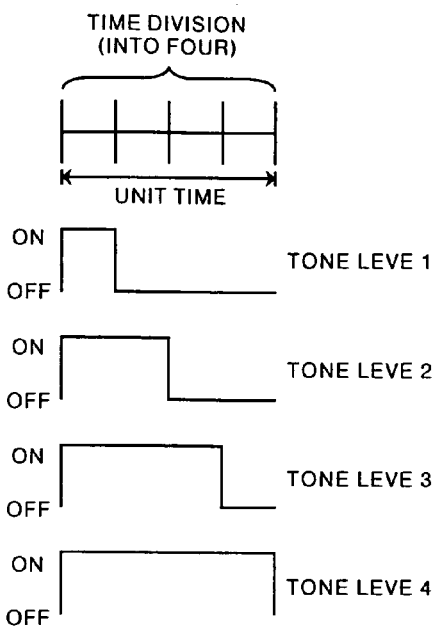
FIG.22
FIG.23A
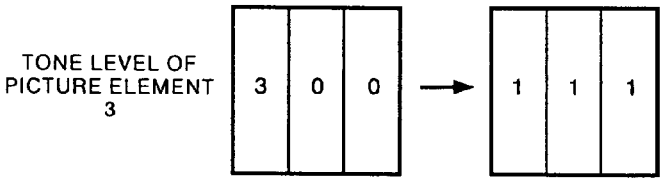
FIG.23B
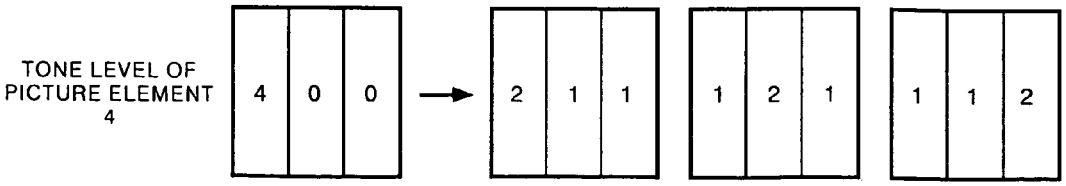

MONOCHROMATIC IMAGE DISPLAY SYSTEM

BACKGROUND OF THE INVENTION

1. Field of the Invention

This invention relates to a monochromatic image display system, and more particularly to multiplication of the number of display tones. This invention further relates to a medical flat display panel for monochromatic image display.

2. Description of the Related Art

As an image display system for displaying a monochromatic image, there has been known one using a CRT (cathode-ray tube). Further there has been in wide use a flat panel display (FPD) using a liquid crystal panel. Owing to the fact that the flat panel display requires less space, is smaller in weight and consumes less power than the cathode-ray tube, it is expected that the flat panel display will spread more widely.

As a method of expressing tones of a monochromatic image in the flat panel display, there has been known a method in which tones are expressed according to a luminance signal (will be referred to as "intensity modulation" hereinbelow). In a system where a liquid crystal panel is employed as a display device, there has been known a method in which tones are expressed by changing the duration of display per unit time by time division drive which controls times for which switches are kept on or off per unit time, e.g., pulse width gradation control or frame thinning control (will be referred to as "time modulation" hereinbelow). For example, see "Denshi Gijutsu", extra edition, May (Vol. 32, No. 7), pp. 110 to 121. Further there has been proposed a method in which the number of tones of a monochromatic image which can be expressed is multiplied by a combination of the time modulation and the intensity modulation.

However this approach is disadvantageous in that the number of tones cannot be unlimitedly multiplied since the number of division of the unit time is limited due to limitation of the response speed of the liquid crystal and it is difficult to display a monochromatic image which is rich in expression.

Further, in the medical field, there have been put into practice various diagnostic image taking means using X-rays or the like such as an X-ray apparatus, a CR (computed radiography) apparatus and the like.

The medical image information obtained by such diagnostic image taking means is subjected to a desired image processing such as a frequency processing, a tone processing and the like and is converted to an TV image signal, for instance, on a NTSC system. Then the TV image signal is reproduced as a visible image on a soft copy system such as a CRT display or as a visible image recorded on a photosensitive material (photographic film) by a LP (laser printer) or the like. The visible image recorded on a photographic film is generally fixed on a view box and submitted to observation. The medical image information obtained by the diagnostic image taking means is thus used in inspecting existence of a lesion or disease and/or the condition thereof. As the soft copy system, though CRT displays have been prevailing in the past,.flat panel displays using a liquid crystal panel, an organic EL panel or the like recently have come to be in wide use and it is expected that the flat panel display will spread more widely in the medical field owing to the fact that the flat panel display requires less space, is smaller in weight and consumes less power than the cathode-ray tube.

The CR (computed radiography) apparatus is a radiation image recording and read-out apparatus which records a radiation image of an object by use of "stimulable phosphor" and has spread widely recently. That is, certain kinds of phosphors, when exposed to a radiation, stores therein a part of the energy of the radiation and emit light in proportion to the stored energy of the radiation when exposed to stimulating rays such as visible light, infrared rays or the like. A phosphor exhibiting such properties is referred to as a stimulable phosphor. In the CR apparatus, the stimulable phosphor layer in the form of a sheet is exposed to a radiation passing through an object such as the human body to have a radiation image of the object stored thereon and is then exposed to stimulating light which cause the stimulable phosphor layer to emit light in proportion to the stored radiation energy, and the light emitted from the stimulable phosphor layer is photoelectrically detected, thereby obtaining an electric image signal representing the radiation image of the object. See, for instance, Japanese Unexamined Patent Publication No. 62(1987)-18536.

In the case where a medical image recorded on a photographic film is observed on a view box as described above, the medical image is observed as a monochromatic image of blue base if the film is of blue base. Since, in the medical field, X-ray films have been of blue base for a long time, doctors and/or radiographers have been accustomed to making a diagnosis on the blue-base image. Accordingly, there has been a demand that medical images should be displayed as a blue-base monochromatic image on a soft copy system as in the case where the medical images are recorded on photographic film and observed on a view box.

However, in flat panel displays such as of liquid crystal, though some of them can make a display in a predetermined monochromatic tone, they are for a green-base or amber-base monochromatic display and not for a blue-base monochromatic display. Accordingly, in order to make a blue-base monochromatic display on a soft copy system, there is nothing for it but to use a display system using color display devices for red, green and blue image signals and cause the display system to make a blue-base monochromatic display by adjusting the signal levels to the respective display devices.

In the display system using color display devices, in order to have the color display devices matched with a black and white display device, the display outputs of R, G and B are set in the ratios of about R:G:B=0.3:0.6:0.1 so that the color display devices are substantially the same as that of the black and white display device, and the mixing value Y (=R+G+B) is taken as the luminance level. In this case, when the R-signal level, the G-signal level and the B-signal level are all at 100%, that is, white level, the display luminance level is at 100%. For example, in the case of a CRT display system, when the display luminance level is at 100%, the maximum luminance is normally about 100 to 200 cd/m$^2$. The maximum luminance of a liquid crystal panel or an organic EL panel is normally lower than that of the CRT display system.

Therefore, when the levels of the R-signal and the G-signal are lowered in a display system using color display devices in order to make a blue-base monochromatic display, the total luminance is lowered greatly below that which can be obtained when the medical image is recorded on a photographic film and observed on a view box, i.e., 5000 to 6000 cd/m$^2$.

From the viewpoint of brightness discriminating ability, it is known that the brightness discriminating ability is maximized when the luminance level is in the range of 50 to 500 cd/m$^2$. When the luminance is 100 to 200 cd/m$^2$ at the maximum, the expression range at film density 1 (minus one figure of the maximum luminance) which is often used in observing medical images is only about 10 to 20 cd/m$^2$, which gives rise to a problem from the viewpoint of brightness discriminating ability. From the viewpoint of sight (resolution), it is said that at least 10 cd/m$^2$ of mean luminance is necessary to keep eyesight of not lower than 1.0. When the expression range is only about 10 to 20 cd/m$^2$, there is little allowance also from the viewpoint of sight, which gives rise to a problem.

In other words, since, in the medical fields, the expression range corresponding to film density 1 is often used, it is preferred that the maximum luminance range be 500 to 5000 cd/m$^2$ so that the expression range corresponding to film density 1 becomes 50 to 500 cd/m$^2$ where the brightness discriminating ability is optimized.

Further each of the R-, G- and B-signals is generally of 8-bit and accordingly, when the monochromatic tones are expressed by mixing these signals, the number of the tones is 256, which is insufficient as a display system of medical images.

SUMMARY OF THE INVENTION

In view of the foregoing observations and description, the primary object of the present invention is to provide a monochromatic image display system which can display a monochromatic image in tones which are larger in number than in conventional systems.

Another object of the present invention is to provide a flat panel display system which can display a blue-base medical image at luminance which is sufficient from the viewpoint of both the brightness discriminating ability and the sight and is equivalent to that which can be obtained when the medical image is recorded on a photographic film and observed on a view box, and can display a blue-base medical image in tones which are sufficient in number for medical applications.

The monochromatic image display system in accordance with a first aspect of the present invention is characterized in that each picture element of a monochromatic image is expressed by a series of cells and the output luminance of the picture element is allotted to the cells (area modulation), and intensity modulation and/or time modulation is carried out on each cell. That is, the monochromatic image display system in accordance with the first aspect of the present invention comprises a display device which can express each picture element of a monochromatic image by a series of cells each of which can express tones in multiple levels, and a cell signal generating means which generates, on the basis of a monochromatic image signal determining the output luminance of a monochromatic image, a cell signal for each cell which determines the output tone level of the cell so that average of the output luminances of all the cells for each picture element corresponds to an output luminance of the picture element.

In this specification, said "multiple levels" means three or more levels.

Further, the expression "so that average of the output luminances of all the cells for each picture element corresponds to an output luminance of the picture element" means "so that average of the output luminances of a series of cells which express each picture element is one-to-one correspondence with an output luminance of the picture element, e.g., is in proportion to an output luminance of the picture element", and the average of the output luminances of the cells for each picture element need not equal to the output luminance of the picture element. However it is preferred that the average of the output luminances of the cells for each picture element be equal to the output luminance of the picture element.

In the monochromatic image display system in accordance with the first aspect of the present invention, it is preferred that the cell signal generating means generates cell signals for a series of cells so that the output luminance of the picture element corresponding to the cells is substantially uniformly allotted to the cells or so that the output luminances of the cells change at an inclination according to a tone gradient vector of picture elements around the picture element corresponding to the cells.

That "the cell signal generating means generates cell signals for a series of cells so that the output luminances of the cells change at an inclination according to a tone gradient vector of picture elements around the picture element corresponding to the cells" mean that, when the tone gradient vector of picture elements around the picture element corresponding to the cells has an inclination, the cell signals are generated so that the output luminances of the cells change at an inclination according to the inclination of the tone gradient vector and when the tone gradient vector has no inclination, the cell signals are generated so that the output luminance of the picture element corresponding to the cells is uniformly allotted to the cells.

In the monochromatic image display system in accordance with the first aspect of the present invention, it is preferred that the cell signal generating means intensity-modulates the input signal levels to the respective cells, which determine the output tone levels of the respective cells (in multiple levels), independently of each other.

Otherwise, the cell signal generating means may time-modulates the input signal levels to the respective cells, which determine the output tone levels of the respective cells (in multiple levels), independently of each other. In this case, the time modulation may be carried out by frame.

When the cell signal generating means carries out the time modulation by frame, it is preferred that the output tone level of each cell be determined so that the output luminances of frames are substantially uniform. The "time modulation" means to express tones by changing the duration of display per unit time by time division drive. For example, pulse width gradation control which is carried out in one frame, or frame thinning control and frame rate control (FRC) which have been realized for a STN liquid crystal panel may be employed. These methods are well known as a method of driving a liquid crystal panel. For example, in the FRC, there have been proposed those in which 8-bit or 10-bit tones can be displayed on the basis of a 6-bit tone signal.

The output tone level of each cell is set so that the maximum number of tones represented by the cell signal does not exceed the maximum number of tones which each cell can express. When the output tone level of each cell is set by time-modulation by frame, the output tone level of each cell is set so that the maximum number of tones represented by the cell signal per one frame does not exceed the maximum number of tones which each cell can express per one frame.

Preferably the maximum number of tones which each cell can express per one frame is not smaller than 64 (6 bits).

It is preferred that the monochromatic image display system in accordance with the first aspect of the present invention be further provided with a tone number conversion means which carries out a tone number conversion processing on an input original monochromatic image signal, thereby generating the monochromatic image signal on the basis of which the cell signal generating means generates said cell signal for each cell.

In this case, it is preferred that the maximum number of tones represented by the monochromatic image signal does not exceed the maximum number of tones which each cell can express. Further it is preferred that the number of tones represented by the original monochromatic image signal is not smaller than 256 (8 bits).

Further in the monochromatic image display system of the first aspect of the present invention, it is preferred that the display device expresses each picture element by three cells. It is further preferred that the display device is a liquid crystal panel.

In the monochromatic image display system in accordance with the first aspect of the present invention, since a display device which can express each picture element by a series of cells is employed, and a cell signal generating means which allots the output luminance of each picture element to the cells (area modulation) and carries out intensity modulation and/or time modulation on each cell is provided, tones can be expressed substantially in a number which is equal to the product of the number in which tones can be expressed by intensity modulation and/or time modulation and the number of the cells for each picture element.

When the cell signal generating means generates cell signals for a series of cells so that the output luminance of the picture element corresponding to the cells is substantially uniformly allotted to the cells, fluctuation in one picture element can be suppressed.

When the cell signal generating means generates cell signals for a series of cells so that the output luminances of the cells change at an inclination according to a tone gradient vector of picture elements around the picture element corresponding to the cells, an oblique line can displayed more sharply as compared with when the output luminance of the picture element corresponding to the cells is uniformly allotted to the cells.

In the monochromatic image display system in accordance with the first aspect of the present invention, a color liquid crystal panel removed with the color filters can be employed as the display device. That is, by eliminating the color filter producing step from the color liquid crystal panel manufacturing steps, a monochromatic liquid crystal panel in which each picture element is formed by three cells can be obtained. Accordingly, the liquid crystal panel which can be employed as the display device in the monochromatic image display system in accordance with the first aspect of the present invention can be very easily manufactured without additional cost. Further the liquid crystal panel driver (controller) for controlling the tone of the liquid crystal panel may be an existing color liquid crystal panel driver.

In accordance with a second aspect of the present invention, there is provided a monochromatic image display system comprising

- a display device which can express each picture element of a monochromatic image by a series of cells each of which can express tones in multiple levels and at least two of which have maximum out levels different from each other, and
- a drive means which drives the cells so that the output level difference per one level differs from each other between said at least two cells.

When the maximum output level of one of said at least two cells is set to be substantially the same as the output level difference per one level of the other cell, the number of the levels of tones which can be expressed by a series of cells for each picture element can be greatly multiplied.

Further it is preferred that the drive means drives the cells so that said at least two cells express tones in substantially the same number of levels.

As the display device for the monochromatic image display system in accordance with the second aspect of the present invention, for instance, a liquid crystal panel provided with monochromatic filters which are different in transmittance and respectively formed on said at least two cells for each picture element so that the maximum output levels of said at least two cells become different from each other, or an organic EL panel in which said at least two cells for each picture element emit light in the same color at different luminances for a given signal level may be suitably employed.

In the monochromatic image display system in accordance with the second aspect of the present invention, since a display device which can express each picture element of a monochromatic image by a series of cells each of which can express tones in multiple levels and at least two of which have maximum out levels different from each other is employed, and the cells are driven so that the output level difference per one level differs from each other between said at least two cells, tones between adjacent levels of the cell which is larger in the output level difference per one level can be expressed by the cell which is smaller in the output level difference per one level, whereby each picture element can be expressed in a larger number of tones. In this case, since the number of tones is not multiplied by time division drive, a problem of flicker does not arise.

Multiplication of the number of display tone levels by the second aspect of the present invention will be described with reference to FIGS. 10A to 10D, hereinbelow. In this description, it is assumed that each picture element of the display system employed in the monochromatic image display system in accordance with the second aspect of the present invention is expressed by a pair of cells (cell a and cell b) as shown in FIG. 10A. FIGS. 10B and 10C schematically show the maximum output levels of the cells a and b, display tone levels of the cells a and b and display tone levels of the picture element each given by a sum of display tone levels of the cells a and b. Display tone levels higher than level a4 of the picture element each given by a sum of display tone level a4 of the cell a and a display tone of the cell b are omitted. (same in FIGS. 11A to 11D and FIG. 12 to be described later)

In FIG. 10B, the number of tone levels of the cell a is four, a1 to a4, but level 0 and the number of tone levels of the cell b is two, b1 and b2, but level 0. The output level differences per one level are uniform in both the cells a and b. The maximum output level b2 of the cell b is lower than that a4 of the cell a and is equal to the third level a3 of the cell a. With this arrangement, the display tone levels as viewed as a picture element can be more finely divided but between level 0 and the level a1 of the cell a, that is, the level b1 is obtained between the levels a1 and a2, level a1+b1 is obtained between the levels a2 and a3 and level a2+b1 is obtained between the levels a3 and a4. This is because the tone level as viewed as a picture element is obtained by addition of the output levels of the respective cells.

Similarly in FIG. 10C, the number of tone levels of the cell a is four, a1 to a4, but level 0 and the number of tone levels of the cell b is six, b1 to b6, but level 0. The output level differences are uniform in both the cells a and b. The maximum output level b6 of the cell b is lower than that a4 of the cell a and is equal to the third level a3 of the cell a.

With this arrangement, the display tone levels as viewed as a picture element can be more finely divided.

The reason why the drive means drives the cells so that the output level difference per one level differs from each other between said at least two cells in the second aspect of the present invention is that, if the output level difference per one level is the same in the two cells, the number of the display tone levels as viewed as a picture element cannot be multiplied as can be seen from FIG. 10D since any sum of a tone level of the cell a and a tone level of the cell b cannot intervene between display tone levels of the cell a or the cell b.

When the maximum output level of one of said at least two cells is set to be substantially the same as the output level difference per one level of the other cell, the number of the levels of tones which can be expressed by a series of cells for each picture element can be greatly multiplied since tones between two adjacent tones of the cell which is higher in the maximum output level can be expressed by tones obtained by the other cell. That is, the tone gap as viewed as a picture element can be reduced to that obtained by said the other cell. Further when those two cells are driven so that they express tones in substantially the same number of levels, the cells can be driven by signals which are the same in the number of bits, which makes it feasible to use a drive circuit such as a liquid crystal controller which is readily available.

Such great multiplication of the number of the levels of tones which can be expressed by a series of cells for each picture element will be described with reference to FIGS. 11A to 11D, hereinbelow. In this description, it is assumed that each picture element of the display system is expressed by a pair of cells (cell a and cell b) as shown in FIG. 11A. In FIG. 11B, the number of tone levels of the cell a is four, a1 to a4, but level 0 and the number of tone levels of the cell b is two, b1 and b2, but level 0. The output level differences per one level are uniform in both the cells a and b. The maximum output level b2 of the cell b is lower than that a4 of the cell a and is equal to the output level difference per one level (=a1) of the cell a. With this arrangement, the display tone levels as viewed as a picture element can be more finely divided, that is, tones between two adjacent output levels of the cell a can be expressed by tones obtained by the cell b. In the case shown in FIG. 11B, multiplication of the number of display tone levels is equal to that obtained in FIG. 10C. When the number of tone levels of the cell b is increased, the number of the levels of tones as viewed as a picture element which can be expressed by the cells can be greatly multiplied as shown in FIGS. 11C and 11*d*.

In FIG. 11C, the number of tone levels of the cell b is three and in FIG. 11D, the number of tone levels of the cell b is four. As can be seen from FIGS. 11C and 11D, the number of the levels of tones as viewed as a picture element can be greatly multiplied by setting the maximum output level of the cell b to be substantially the same as the output level difference per one level of the cell a and increasing the number of tone levels of the cell b.

In the monochromatic image display in accordance with the second aspect of the present invention, the number of cells for each picture element need not be limited to two. Fir example, each picture element may be expressed by three cells, a, b and c, as shown in FIG. 12. In FIG. 12, the number of tone levels of the cell a is four, a1 to a4, but level 0, the number of tone levels of the cell b is four, b1 to b4, but level 0, and the number of tone levels of the cell c is two, c1 and c2, but level 0. The output level differences per one level are uniform in all the cells a, b and c. The maximum output level b4 of the cell b is lower than that a4 of the cell a and is equal to the output level difference per one level (=a1) of the cell a. Further the maximum output level c2 of the cell c is lower than that b4 of the cell b and is equal to the output level difference per one level (=b1) of the cell b. With this arrangement, the display tone levels as viewed as a picture element can be more finely divided, that is, tones between two adjacent output levels of the cell b can be expressed by tones obtained by the cell c and tones between two adjacent output levels of the cell a can be expressed by tones obtained by the cell b or tones obtained by a combination of the cells b and c.

As the display device for the monochromatic image display system in accordance with the second aspect of the present invention, for instance, a liquid crystal panel provided with monochromatic filters which are different in transmittance and respectively formed on said at least two cells for each picture element so that the maximum output levels of said at least two cells become different from each other, or an organic EL panel in which said at least two cells for each picture element emit light in the same color at different luminances for a given signal level may be suitably employed.

Further, in the monochromatic image display system in accordance with the second aspect of the present invention, a color liquid crystal panel removed with the color filters can be employed as the display device. That is, by eliminating the color filter producing step from the color liquid crystal panel manufacturing steps, a monochromatic liquid crystal panel in which each picture element is formed by three cells can be obtained. Accordingly, the liquid crystal panel which can be employed as the display device in the monochromatic image display system in accordance with the second aspect of the present invention can be very easily manufactured without additional cost. Further the liquid crystal panel driver (controller) for controlling the tone of the liquid crystal panel may be an existing color liquid crystal panel driver.

Further when a liquid crystal panel provided with monochromatic filters which are different in transmittance and respectively formed on two cells for each picture element so that the maximum output levels of these two cells become different from each other is employed as the display device, manufacture of the display device is facilitated. That is, by forming, in the color liquid crystal panel manufacturing steps, monochromatic filters which are different in transmittance respectively on two cells for each picture element using a mask which is used for forming color filters, a liquid crystal panel in which each picture element is formed by a pair of cells can be obtained. Accordingly, a display device which can be employed in the monochromatic image display system of the second aspect can be easily formed without additional cost such as for developing a mask for forming the monochromatic filters. Further an existing color liquid crystal panel driver can be employed as it is as the liquid crystal panel driver (controller) for controlling the tone of the liquid crystal panel.

Further an organic EL panel in which two cells for each picture element emit light in the same color at different luminances for a given signal level can be employed as the display device in the monochromatic image display system of the second aspect of the present invention without forming monochromatic filters on the cells.

Further when a liquid crystal panel with bluish filters or an organic EL panel which emits light in a bluish color is employed as the display device, a monochromatic image display system which can display a blue-base medical image suitable for diagnosis can be obtained.

In accordance with a third aspect of the present invention, there is provided a flat- panel image display system using a flat panel-like display device characterized in that the display device is a monochromatic display device which makes a display in a color which falls within the region surrounded by points (0.174, 0), (0.4, 0.4) and ($\alpha$, 0.4) as represented by co-ordinates (x, y) on a CIE chromaticity diagram, wherein $\alpha$ represents the x-coordinate of the intersection of a spectrum locus and a straight line y=0.4.

The monochromatic display device may be, for instance, a display device which is provided with at least one of elements including a substrate such as of glass, a face plate, a diffuser panel, a color filter, a diffuser film, a collimator film, a prism film and a polarizing film which are colored to a predetermined color.

The predetermined color is a color which makes the displaying color of the display device fall within the aforesaid region. When the displaying color of the display device falls within the aforesaid region, a blue-base display can be obtained, and it is generally preferred that said element be colored to a bluish color though it is possible to make the displaying color of the display device fall within the aforesaid region by coloring the element to a different color.

The face plate is a plate which is placed on the display surface of the display device and is generally provided with a protective film for preventing reflection or for protecting the surface from being scratched.

The diffuser panel is a panel for diffusing light emitted from a light source disposed on the rear or front face of a device in a flat panel display device especially in a liquid crystal panel.

The diffuser film and the collimator film are films which are employed to increase the angle of view in a flat panel display device especially in a liquid crystal panel. The prism film is a film which is employed to increase the luminance in a flat panel display device especially in a liquid crystal panel.

To color the diffuser film to a predetermined color means to color at least one of the diffusing portion and the base film of the diffuser film to the predetermined color. To color the collimator film to a predetermined color means to color at least one of the collimating portion and the base film of the collimator film to the predetermined color. To color the prism film to a predetermined color means to color at least one of the prism portion and the base film of the prism film to the predetermined color.

It is preferred that the display device comprises a plurality of cells and can express each picture element of a monochromatic image by a series of cells, and there is provided at least one of an area modulation means which controls the output luminance of each picture element by selectively turns on and off input signals to the respective cells for the picture element independently of each other, a time modulation means which drives the respective cells for each picture element in a time division system, and an intensity modulation means which controls input signal levels to the respective cells for each picture element independently of each other, wherein the cells are driven so that the maximum luminance of each picture element is preferably in the range of 100 cd/m$^2$ to 10000 cd/m$^2$, and more preferably in the range of 500 cd/m$^2$ to 5000 cd/m$^2$.

The "time modulation" means to express tones by changing the duration of display per unit time. For example, pulse width gradation control, or frame thinning control and frame rate control (FRC) which have been realized for a STN liquid crystal panel may be employed. These methods are well known as a method of driving a liquid crystal panel. For example, in the FRC, there have been proposed those in which 8-bit or 10-bit tones can be displayed on the basis of a 6-bit tone signal.

As the display device for the flat panel display system of the third aspect of the present invention, a liquid crystal panel and an organic EL panel are preferred.

In the flat panel display system of the third aspect of the present invention, since the display device is a monochromatic display device whose displaying color is blue which falls within the aforesaid region on a CIE chromaticity diagram, a blue-base monochromatic image can be displayed.

The displaying color of the monochromatic display device can be made to fall within the aforesaid region on a CIE chromaticity diagram by simply coloring to a predetermined color at least one of elements including a substrate, a face plate, a diffuser panel and the like, and accordingly such a display device can be easily manufactured.

Further when a monochromatic filter of a predetermined color is used and/or other components are colored to a predetermined color, luminance of display can be made high and a bright blue-base monochromatic image can be displayed without taking into account matching with a black and white display device.

Further by using a display device which comprises a plurality of cells and can express each picture element of a monochromatic image by a series of cells, allotting tones of each picture element represented by a monochromatic image signal to the cells and carrying out intensity modulation and/or time modulation on each cell, the number of the levels of tones as viewed as a picture element which can be expressed by the cells can be increased to the number of tones which can be expressed by time modulation and/or intensity modulation multiplied by the number of the cells for each picture element. Further by setting the maximum luminance of each picture element in the range of 100 cd/m$^2$ to 10000 cd/m$^2$ (more preferably in the range of 500 cd/m$^2$ to 5000 cd/m$^2$), a blue-base image can be displayed at luminance which is equivalent to that which can be obtained when an image is recorded on a photographic film and observed on a view box, that is, 50 to 500 cd/m$^2$ where the brightness discriminating ability and the sight are optimized. The reason why the maximum luminance of each picture element can be set so high is that the maximum luminance of each picture element is the maximum luminance of each cell multiplied by the number of the cells. When a flat panel display system in accordance with the third aspect of the present invention is employed as a medical image display system for a CR apparatus or the like, a blue-base medical image which are sufficient for medical applications in number of tones and in luminance can be displayed.

Further when a liquid crystal panel is employed as the display device, the liquid crystal panel may be manufactured by simply substituting the color filters of a color liquid crystal panel by the aforesaid monochromatic filters. That is, by forming, in-the color liquid crystal panel manufacturing steps, the aforesaid monochromatic filters on the cells for each picture element using a mask which is used for forming the color filters, a blue-base liquid crystal panel in which each picture element is formed by three cells can be obtained. Accordingly, a liquid crystal panel which can be employed in the flat panel display system of the third aspect can be easily formed without additional cost such as for developing a mask for forming the monochromatic filters. Further an existing color liquid crystal panel driver can be employed as it is as the liquid crystal panel driver (controller) for controlling the tone of the liquid crystal panel.

Further an organic EL panel consisting of an array of a plurality cells which emit light in the same color can be employed as the display device in the flat panel display system of the third aspect of the present invention without forming monochromatic filters on the cells.

BRIEF DESCRIPTION OF THE DRAWINGS

FIG. 22 is a view for illustrating time modulation, FIGS. 23A and 23B are views for illustrating allotment of density.

DESCRIPTION OF THE PREFERRED EMBODIMENTS

Embodiment of the present invention will be described in detail with reference to the drawings, hereinbelow.

Figure 1:
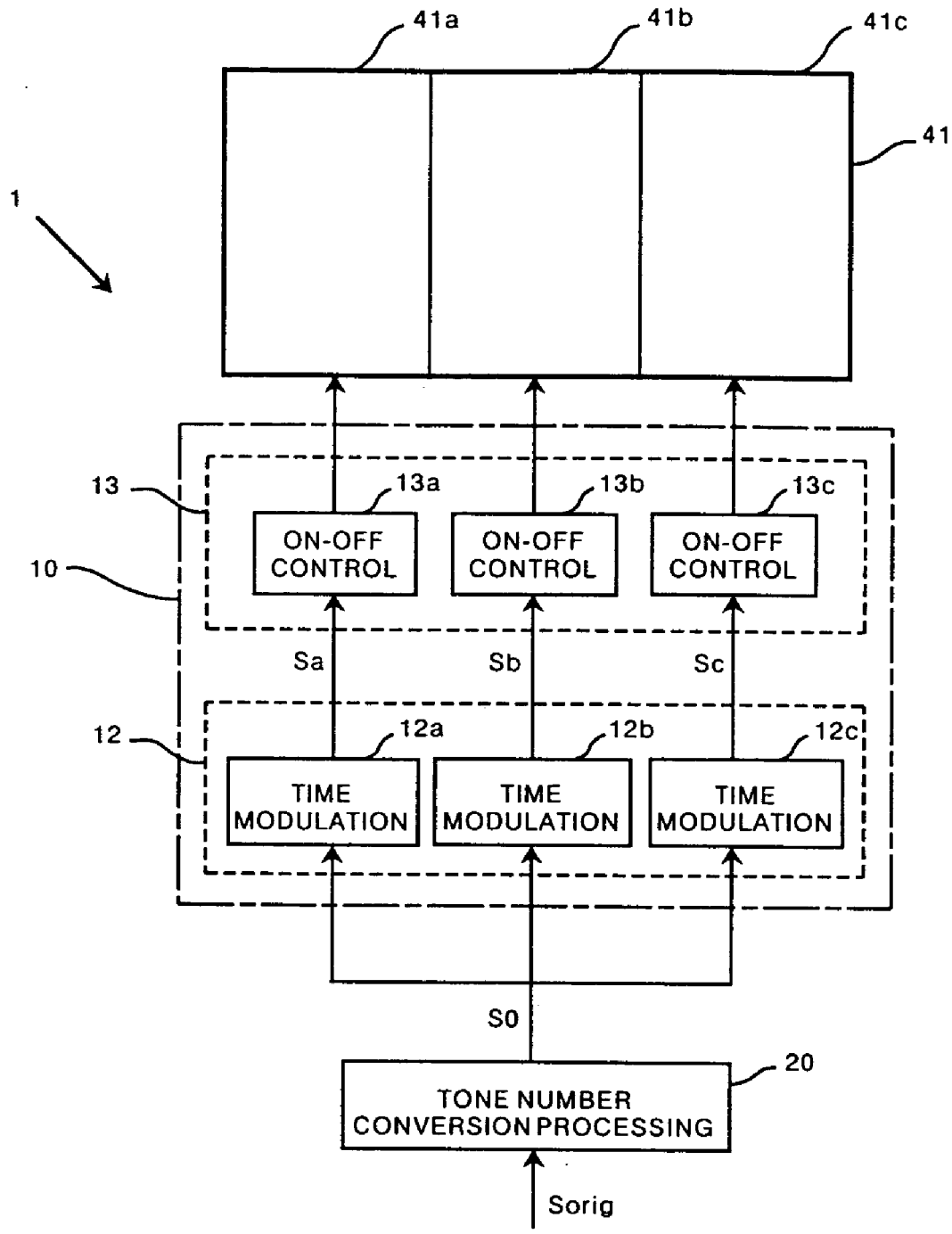
FIG. 1 is a block diagram showing the arrangement of a monochromatic image display system in accordance with a first embodiment of the present invention (area modulation+time modulation by pulse width gradation control) for one picture element of a liquid crystal panel.
Figure 2:
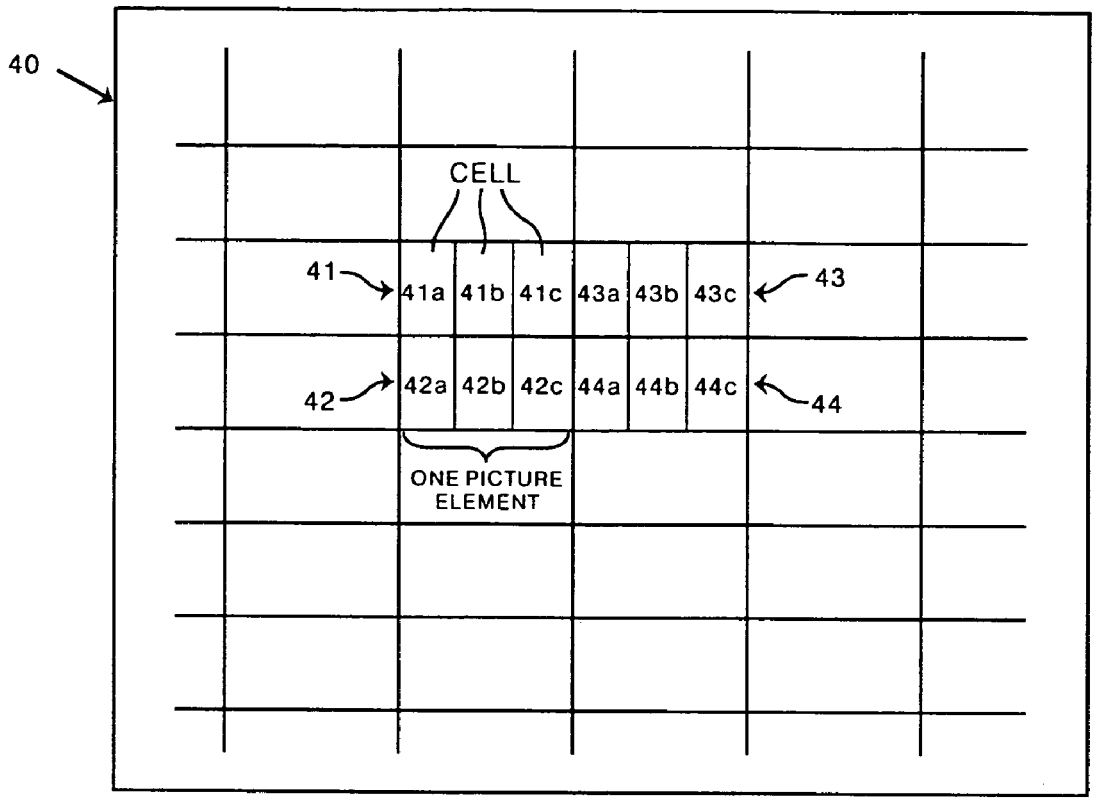
FIG. 2 is a view showing the picture element arrangement and the cell arrangement of a liquid crystal panel employed in the monochromatic image display system of the first embodiment.

FIG. 1 is a block diagram showing the arrangement of a monochromatic image display system in accordance with a first embodiment of the present invention and FIG. 2 is a view showing the picture element arrangement and the cell arrangement of a display device employed in the monochromatic image display system of the first embodiment.

In the monochromatic image display system 1 of the first embodiment, a liquid crystal panel 40 is employed as the display device. The liquid crystal panel 40 is in the form of a color liquid crystal panel removed with color filters and can express each picture element of a monochromatic image by three cells as shown in FIG. 2. For example, each of picture elements 41, 42, 43 and 44 can be expressed by three cells (e.g., cells 41*a*, 41*b* and 41*c* for the picture element 41). Each cell can express tones in multiple levels and when intensity modulation and/or time modulation (by pulse width gradation control or by FRC) to be described later is to be carried out, an input signal to each cell is generated according to the value of a monochromatic image signal for each picture element within a maximum number of the tone levels which can be expressed by the cell.

In the monochromatic image display system 1 of this embodiment, the number of display tone levels is multiplied by a combination of area modulation and time modulation. As shown in FIG. 1, the monochromatic image display system 1 is provided for each picture element (the picture element 41 in the example shown in FIG. 1) with a tone number conversion processing means 20 which carries out a tone number conversion processing on an original monochromatic image signal (will be referred to as "the original image signal", hereinbelow) Sorig and generates a monochromatic image signal So which determines the output luminance of the picture element 41, and a cell signal generating means 10 which comprises a time modulation means 12 and an on-off control means 13. The time modulation means 12 generates, on the basis of the generated monochromatic image signal So, cell signals Sa, Sb and Sc which respectively determine the output tone levels of the cells 41*a*, 41*b* and 41*c* for the picture element 41. The time modulation means 12 comprises three time modulating sections 12*a*, 12*b* and 12*c* for the respective cells 41*a*, 41*b* and 41*c* and the on-off control means 13 comprises three on-off control sections 13*a*, 13*b* and 13*c* for the respective cells 41*a*, 41*b* and 41*c*. The time modulation means 12 and the on-off control means 13 are connected to the liquid crystal panel 40 in series.

The tone number conversion processing means 20 carries out a tone number conversion processing on an input original monochromatic image signal (will be referred to as "the original image signal", hereinbelow) Sorig according to the display capacity of the liquid crystal panel 40 so that tone control can be effected within the number of tone levels which the liquid crystal panel 40 can express.

The cell signal generating means 10 generates the cell signals Sa, Sb and Sc for the cells 41*a*, 41*b* and 41*c* for the picture element 41 so that the sum of the output luminances of the cells 41*a*, 41*b* and 41*c* corresponds to the output luminance of the picture element 41. The time modulation means 12 first carries out pulse width modulation in one frame and controls the display tone level of each of the cells 41*a*, 41*b* and 41*c*. Then the on-off control means 13 turns on and off the cell signals Sa, Sb and Sc output from the time modulation means 12 independently of each other, thereby controlling input of the cell signals Sa, Sb and Sc into the cells 41*a*, 41*b* and 41*c*.

The operation of the monochromatic image display system 1 of this embodiment will be described, hereinbelow.

FIGS. 3A to 3D are views for illustrating the operation of the tone number conversion processing means 20.

Figure 3A:
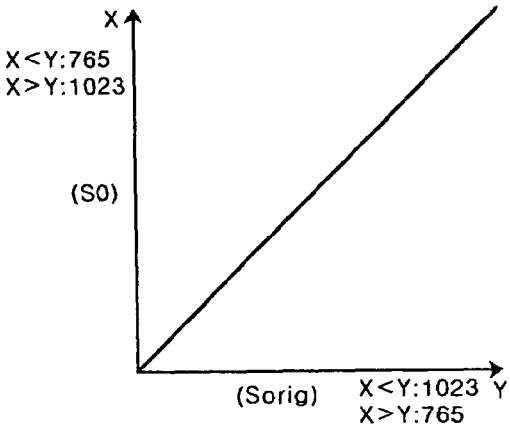
FIGS. 3A to 3D are views for illustrating the tone number conversion processing, FIG. 3A being for illustrating an example of linear conversion, FIG. 3B being for illustrating an example of nonlinear conversion, FIG. 3C being for showing an example of luminance-tone characteristics of the display device, and FIG. 3D being for illustrating an example of nonlinear conversion for the luminance-tone characteristics shown in FIG. 3C.
Figure 3B:
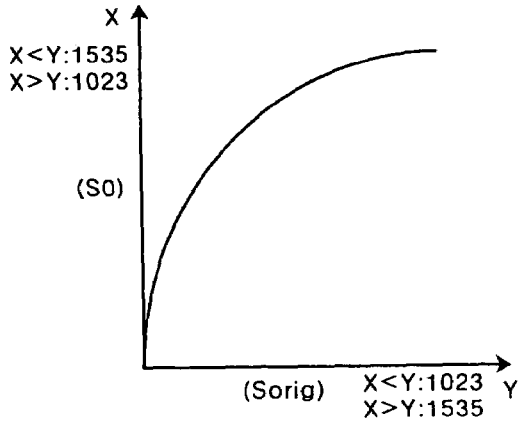

The tone number conversion processing means 20 carries out a tone number conversion processing on an input original image signal Sorig according to the display capacity of the liquid crystal panel 40. That is, the tone number conversion processing means 20 generates a monochromatic image signal So by compressing the number of tone levels of the original image signal Sorig when the maximum number of display tone levels X which the liquid crystal panel 40 can express is smaller than the maximum number of tone levels Y of the original image signal Sorig (X<Y) and by expanding the number of tone levels of the original image signal Sorig when X is larger than Y (X>Y). The tone number conversion processing may be a linear conversion as shown in FIG. 3A or a nonlinear conversion as shown in FIG. 3B.

Figure 3C:
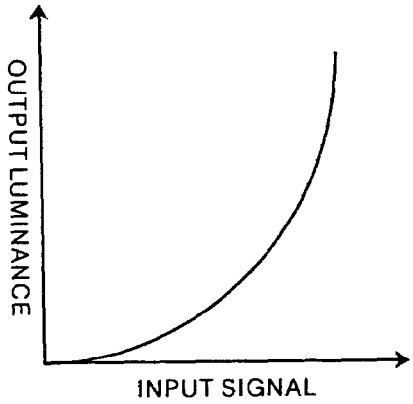
Figure 3D:
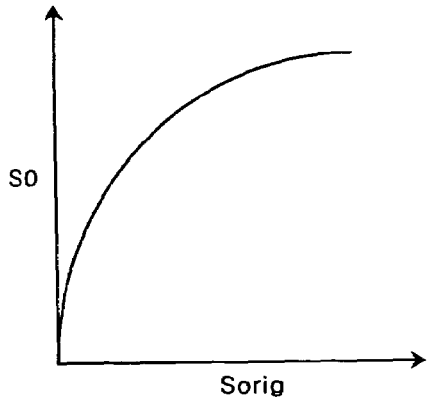

When the luminance-tone characteristics of the display device is to be corrected, it is preferred to carry out a nonlinear conversion and since it is necessary to multiply the number of display tone levels, a display device whose maximum number of display tone levels X is larger than the maximum number of tone levels Y of the original image signal Sorig is used. Generally the luminance-tone characteristics of a display device are convex downward as shown in FIG. 3C and in this case, resolution is poor on the low luminance side. Accordingly, in this case, it is preferred that a nonlinear conversion be carried out so that the luminance-tone characteristics of the monochromatic image signal So become convex upward as shown in FIG. 3D.

Figure 4:
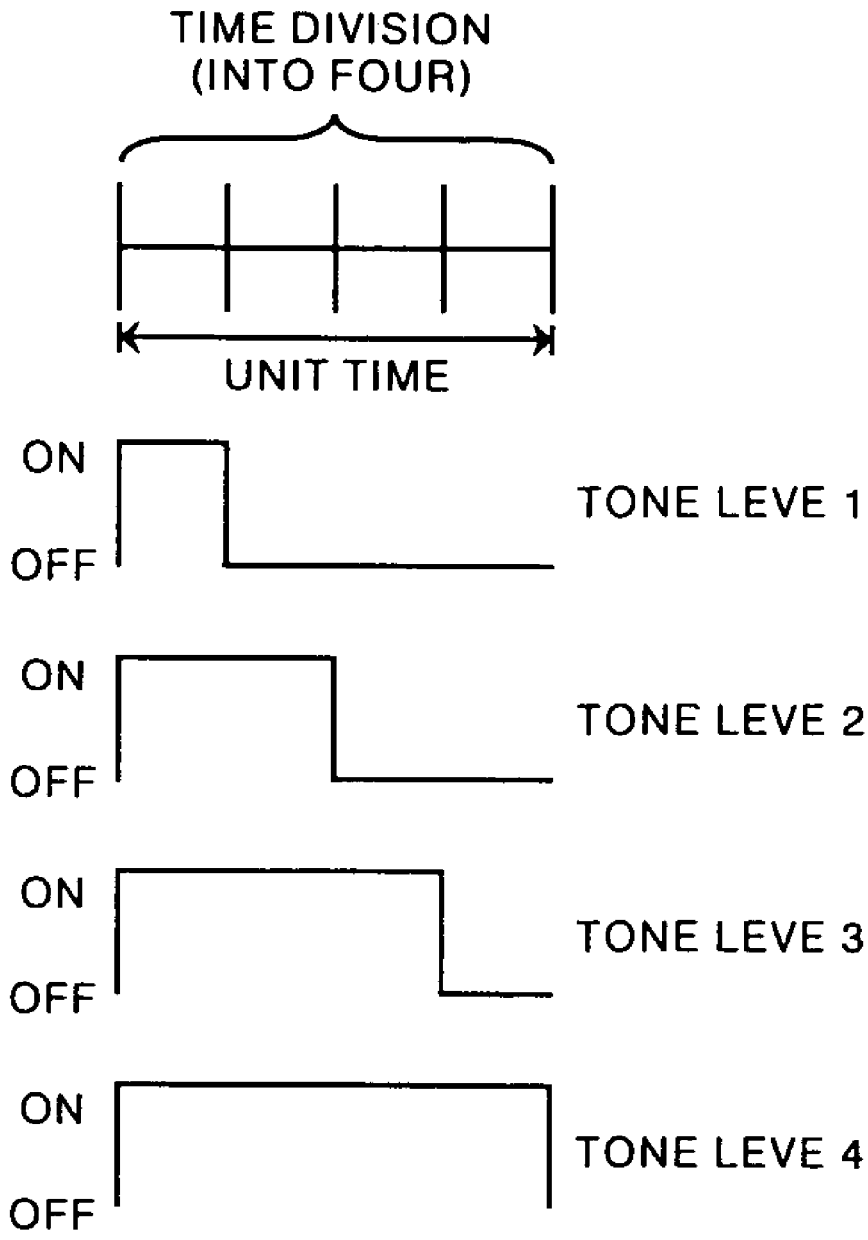
FIG. 4 is a view for illustrating time modulation.

FIG. 4 is a view for illustrating the operation of the time modulation means 12. In this embodiment, the time modulation means 12 divides a unit time (one frame) into four time segments and carries out a time division drive in which the input signal is selectively turned on and off by the time segment. Then the cell signals Sa, Sb and Sc which are output signals of the respective time modulating sections 12*a*, 12*b* and 12*c* are respectively input into the on-off control sections 13*a*, 13*b* and 13*c* of the on-off control means 13. Accordingly when the input signal is turned on for only one time segment, tone level 1 is expressed, and when the input signal is turned on for two time segments, tone level 2 is expressed. Thus four tone levels (but tone level 0) can be expressed in total by each cell. The on-off control means 13 turns on and off the cell signals Sa, Sb and Sc input into the respective cells 41*a*, 41*b* and 41*c* from the time modulation means 12 independently of each other. When the cell signal input into each cell is turned off, tone level 0 is expressed. Since tone level 0 can be expressed by turning off the input signal for all the time segments by the time modulation means 12, the outputs of the time modulating sections of the time modulation means 12 may be directly input into the respective cells without providing the on-off control means 13.

Since each picture element of the liquid crystal panel 40 employed in the monochromatic image display system 1 of this embodiment is expressed by three cells and the time modulation means 12 and the on-off control means 13 are provided for each picture element, the liquid crystal panel 40 can express thirteen tone levels (4×3+1=13) in total (tone level 0 inclusive).

Though, in the example described above, a liquid crystal panel in which each picture element is expressed by three cells is employed as the display device, a liquid crystal panel in which each picture element is expressed by a plurality of (M in number) cells may be employed as the display device. In this case, the liquid crystal panel can express M×N+1 tones in total (tone level 0 inclusive), wherein N represents the number of display tone levels which can be expressed by time modulation of each cell. That is, by expressing each picture element of a monochromatic image by M cells, allotting the tone corresponding to the input monochromatic image signal So to the cells and carrying out time modulation on each cell according to the allotted tone, the number of display tone levels can be multiplied to M×N+1 (tone level 0 inclusive) whereas the number of display tone levels obtained solely by time modulation is only N+1 (tone level 0 inclusive).

FIGS. 5A to 5C and FIGS. 6A to 6C are views for illustrating methods of allotting luminance to the cells when each picture element of a monochromatic image is expressed by a plurality of cells. In the monochromatic image display system of this embodiment, the cell signal for each cell may be generated so that the output luminance of each picture element is uniformly allotted to the cells (will be described as "uniform allotment method", hereinbelow) or may be generated so that the output luminances of the cells change at an inclination according to the inclination of the tone gradient vector of picture elements around the picture element corresponding to the cells (will be described as "vector allotment method", hereinbelow).

The uniform allotment method is for allotting luminance to the cell as uniform as possible so that unevenness of luminance in one picture element is suppressed. This allotment can be realized by causing the time modulation means 12 to carry out pulse width gradation control so that cell signals which cause the display luminances of the respective cells to become substantially uniform are input into the respective cells. For example, in the case where the display luminances of the respective cells become equal to each other when cell signals at the same tone level are input into the respective cells, cell signals at substantially the same tone level may be input into the respective cells.

Figure 5A:
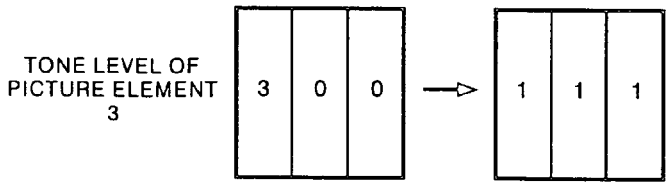
FIGS. 5A to 5C are views for illustrating uniform allotment of luminance.
Figure 5B:
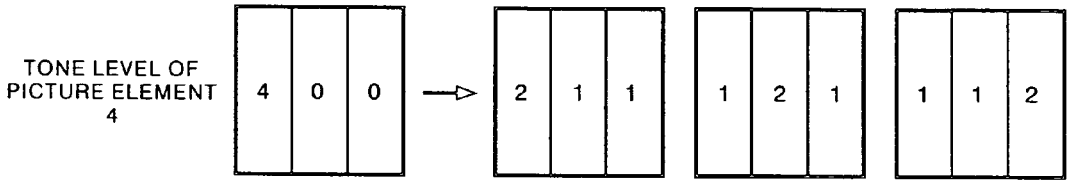
Figure 5C:
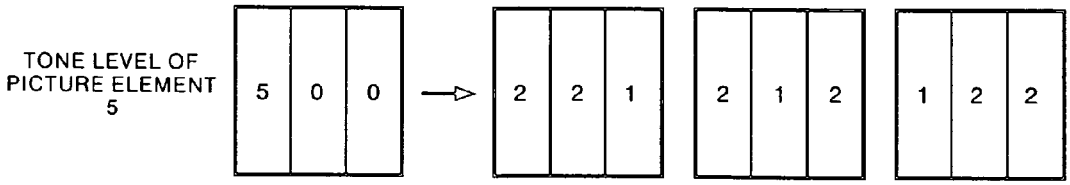

FIGS. 5A to 5C show a concrete example of the uniform allotment method. FIG. 5A shows a case where the tone level (luminance level) is 3. As shown in FIG. 5A, in such a case, the tone levels are not allotted to the cells as [3, 0, 0] but uniformly allotted to the cells as [1, 1, 1]. In the case where the tone level is 4, the tone levels are not allotted to the cells as [4, 0, 0] but allotted to the cells as uniformly as possible as [2, 1, 1], [1, 2, 1] or [1, 1, 2] as shown in FIG. 5B. In the case where the tone level is 5, the tone levels are not allotted to the cells as [5, 0, 0] but allotted to the cells as uniformly as possible as [2, 2, 1], [1, 2, 2] or [2, 1, 2] as shown in FIG. 5C.

The vector allotment method realizes a sharper display by causing the output luminances of the cells to change at an inclination according to a tone gradient vector of picture elements around the picture element corresponding to the cells.

Figure 6A:
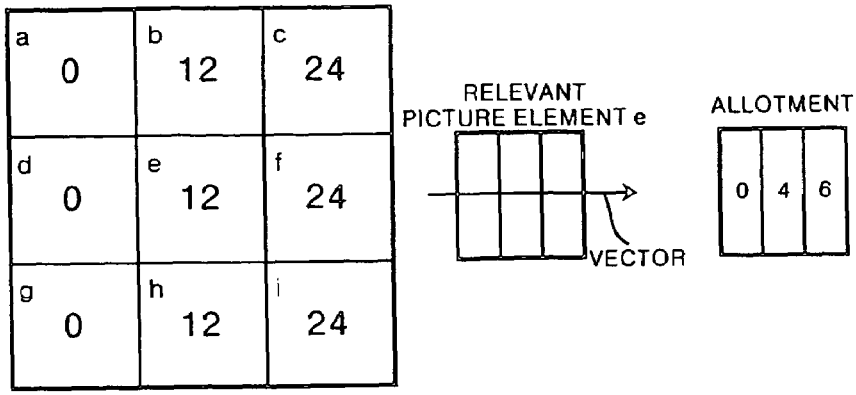
FIGS. 6A to 6C are views for illustrating vector allotment of luminance.
Figure 6B:
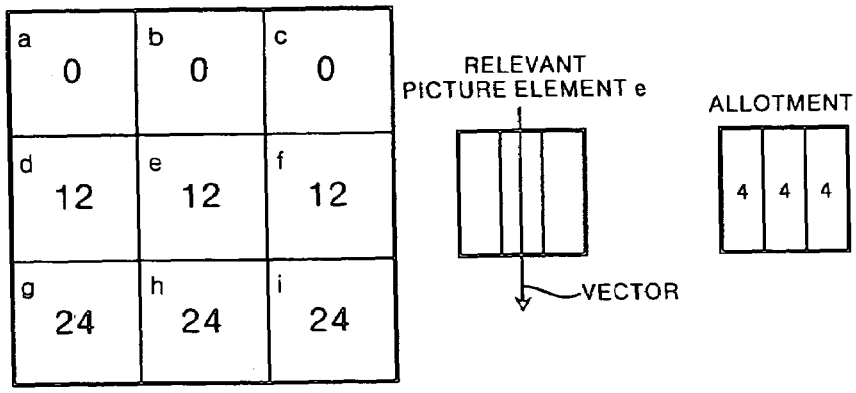
Figure 6C:
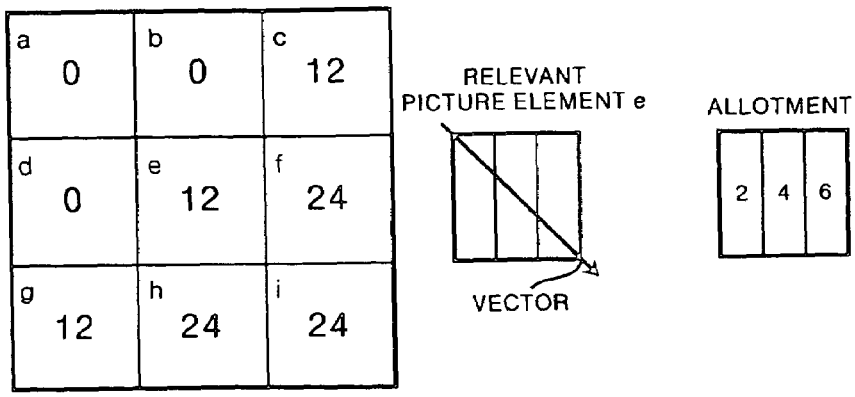

FIGS. 6A to 6C show a concrete example of the vector allotment method where cell signals for the cells corresponding to a relevant picture element e are caused to change at an inclination according to a tone gradient vector obtained on the basis of the relevant picture element e and eight picture elements a to d and f to i around the relevant picture element e.

FIG. 6A shows a case where the tone levels of the picture elements a, d and g are 0, those of the picture elements b, e and h are 12 and those of the picture elements c, d and i are 24. In this case, since the direction of the tone gradient vector conforms to the direction of the array of the cells and the inclination of the tone levels (corresponding to luminance) is relatively large, the tone level 12 of the relevant picture element e is allotted to the cells as [0, 4, 8] so that the luminance is largely inclined in the relevant picture element e.

FIG. 6B shows a case where the tone levels of the picture elements a, b and c are 0, those of the picture elements d, e and f are 12 and those of the picture elements g, h and i are 24. In this case, since the direction of the tone gradient vector is perpendicular to the direction of the array of the cells and the inclination of the tone levels is zero, the tone level 12 of the relevant picture element e is uniformly allotted to the cells as [4, 4, 4] so that unevenness in luminance is not generated in the relevant picture element e.

FIG. 6C shows a case where the tone levels of the picture elements a, d and d are 0, those of the picture elements c, e and g are 12 and those of the picture elements f, h and i are 24. In this case, since the direction of the tone gradient vector is to the direction of the array of the cells and the inclination of the tone levels is relatively small, the tone level 12 of the relevant picture element e is allotted to the cells as [2, 4, 6] so that inclination of the luminance is small in the relevant picture element e.

As described above, a liquid crystal panel 40 in which each picture element of a monochromatic image is expressed by three cells is employed as the display device. This will be described hereinbelow. In a color liquid crystal panel, each picture element is expressed by three cells which are respectively provided with R (red), G (green) and B (blue) filters. The liquid crystal panel 40 in which each picture element of a monochromatic image is expressed by three cells can be obtained by removing the color liquid crystal panel with the R, G and B filters. Accordingly, by eliminating the color filter producing step from the color liquid crystal panel manufacturing steps, a monochromatic liquid crystal panel which can be employed in this embodiment can be obtained. Further, in the recently available liquid crystal panels, color liquid crystal panels are less expensive than monochromatic liquid crystal panels. Accordingly, the liquid crystal panel which can be employed as the display device in the monochromatic image display system of this embodiment can be very easily manufactured without additional cost. Further the controller for controlling the tone of the liquid crystal panel may be an existing color liquid crystal panel driver, and the tone of a monochromatic image can be easily controlled by controlling the R, G and B inputs by use of the existing color liquid crystal panel driver.

Figure 7:
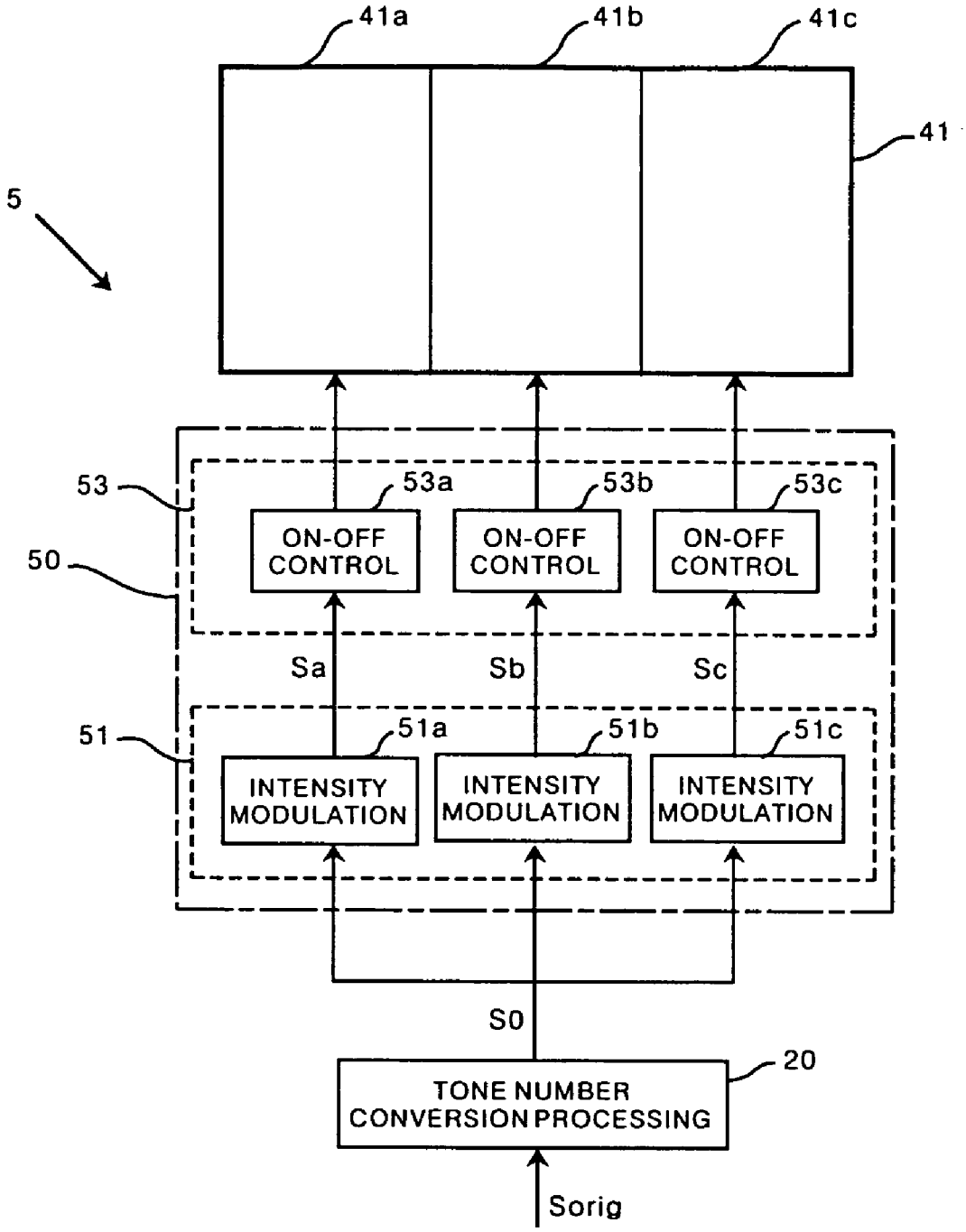
FIG. 7 is a block diagram showing the arrangement of a monochromatic image display system in accordance with a second embodiment of the present invention (area modulation+intensity modulation) for one picture element of a liquid crystal panel.

A monochromatic image display system in accordance with a second embodiment of the present invention will be described with reference to FIG. 7, hereinbelow. FIG. 7 is a block diagram showing the arrangement of the monochromatic image display system in accordance with the second embodiment of the present invention for one picture element. As the display device, a liquid crystal panel 40 shown in FIG. 2 is employed.

In the monochromatic image display system 5 of the second embodiment, the number of display tone levels is multiplied by a combination of area modulation and intensity modulation. As shown in FIG. 7, the monochromatic image display system 5 is provided for each picture element (the picture element 41 in the example shown in FIG. 7) with a cell signal generating means 50 which comprises an intensity modulation means 51 and an on-off control means 53. The intensity modulation means 51 generates, on the basis of the monochromatic image signal So, cell signals Sa, Sb and Sc which respectively determine the output tone levels of the cells 41*a*, 41*b* and 41*c* for the picture element 41. The intensity modulation means 51 comprises three time modulating sections 51*a*, 51*b* and 51*c* for the respective cells 41*a*, 41*b* and 41*c* and the on-off control means 53 comprises three on-off control sections 53*a*, 53*b* and 53*c* for the respective cells 41*a*, 41*b* and 41*c*. The intensity modulation means 51 and the on-off control means 53 are connected to the liquid crystal panel 40 in series.

The cell signal generating means 50 generates the cell signals Sa, Sb and Sc for the cells 41*a*, 41*b* and 41*c* for the picture element 41 so that the sum of the output luminances of the cells 41*a*, 41*b* and 41*c* corresponds to the output luminance of the picture element 41. The intensity modulation means 51 controls the display tone level of each of the cells 41*a*, 41*b* and 41*c* by controlling the voltage imparted to each of the cells 41*a*, 41*b* and 41*c*, that is, by intensity modulation. Then the on-off control means 53 turns on and off the cell signals Sa, Sb and Sc output from the intensity modulation means 51 independently of each other, thereby controlling input of the cell signals Sa, Sb and Sc into the cells 41*a*, 41*b* and 41*c*. Since tone level 0 can be expressed by making zero the input signal levels to the cells by the intensity modulation means 51, the outputs of the intensity modulating sections of the intensity modulation means 51 may be directly input into the respective cells without providing the on-off control means 53.

As in the monochromatic image display system 1 of the first embodiment, the tone corresponding to the input monochromatic image signal So is allotted to the cells by said uniform allotment method, the vector allotment method or the like.

Also in the monochromatic image display system 5 of this embodiment, when each picture element is expressed by a plularity of (M in number) cells and the number of display tone levels which can be expressed by intensity modulation of each cell is set to L (but tone level 0), M×L+1 tones (tone level 0 inclusive) can be expressed in total. That is, by expressing each picture element of a monochromatic image by M cells, allotting the tone corresponding to the input monochromatic image signal So to the cells and carrying out intensity modulation on each cell according to the allotted tone, the number of display tone levels can be multiplied to M×L+1 (tone level 0 inclusive) whereas the number of display tone levels obtained solely by intensity modulation is only L+1 (tone level 0 inclusive).

Figure 8:
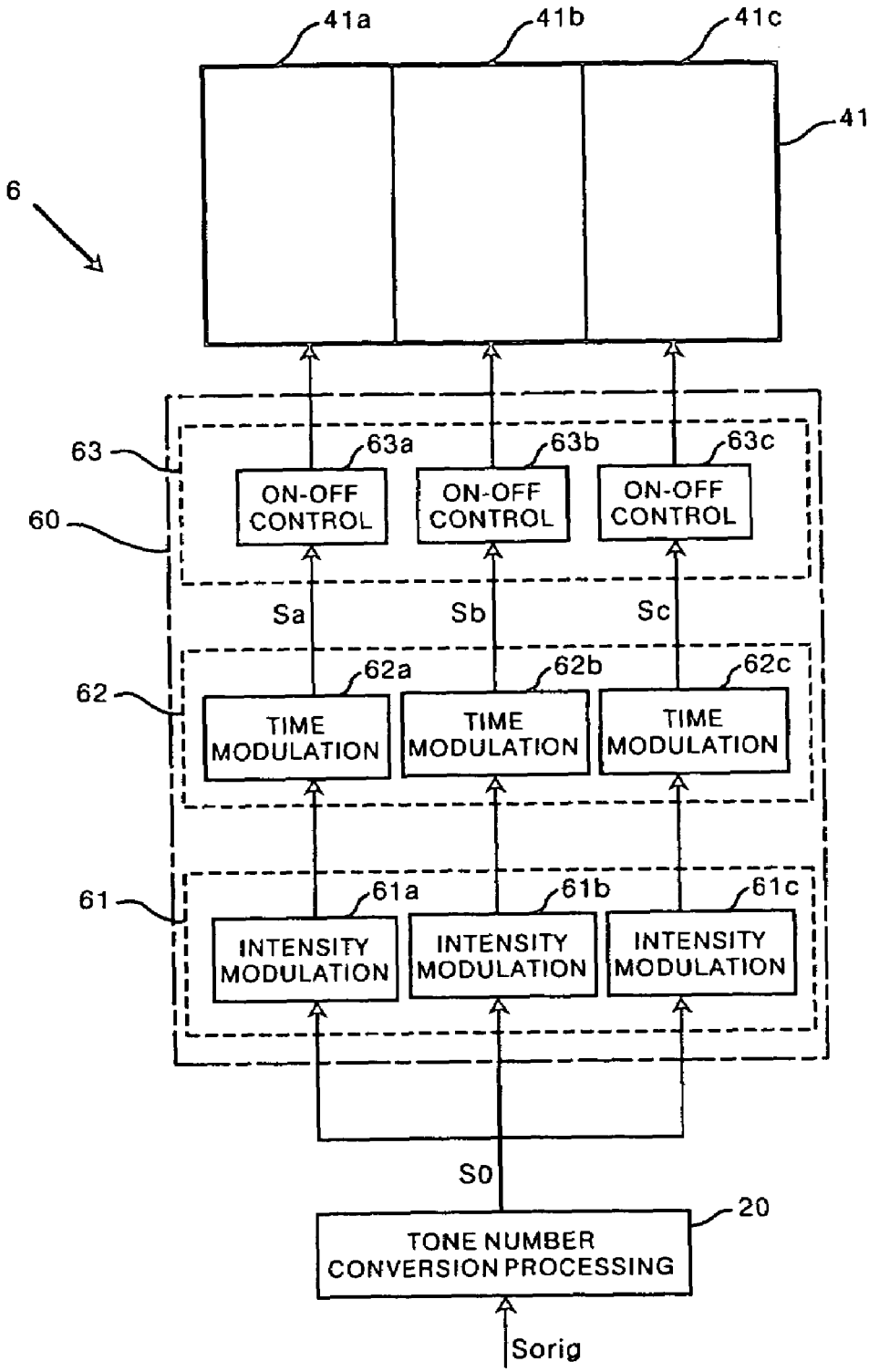
FIG. 8 is a block diagram showing the arrangement of a monochromatic image display system in accordance with a third embodiment of the present invention (area modulation+intensity modulation+time modulation by pulse width gradation control) for one picture element of a liquid crystal panel.

A monochromatic image display system in accordance with a third embodiment of the present invention will be described with reference to FIG. 8, hereinbelow. FIG. 8 is a block diagram showing the arrangement of the monochromatic image display system in accordance with the third embodiment of the present invention for one picture element. As the display device, a liquid crystal panel 40 shown in FIG. 2 is employed.

The monochromatic image display system 6 of the third embodiment is a combination of the image display systems 1 and 5 of the first and second embodiments, and in the monochromatic image display system 6 of the third embodiment, the number of display tone levels is multiplied by a combination of area modulation, time modulation and intensity modulation. As shown in FIG. 8, the monochromatic image display system 6 is provided for each picture element with a cell signal generating means 60 which comprises an intensity modulation means 61 which carries out intensity modulation on the basis of the monochromatic image signal So, a time modulation means 62 which carries out pulse width gradation control on the output signals S61*a*, S61*b* and S61*c* of the intensity modulation means 61 and an on-off control means 63. The intensity modulation means 61 comprises three intensity modulating sections 61*a*, 61*b* and 61*c* for the respective cells 41*a*, 41*b* and 41*c*, the time modulation means 62 comprises three time modulating sections 62*a*, 62*b* and 62*c* for the respective cells 41*a*, 41*b* and 41*c* and the on-off control means 63 comprises three on-off control sections 63*a*, 63*b* and 63*c* for the respective cells 41*a*, 41*b* and 41*c*. The intensity modulation means 61, the time modulation means 62 and the on-off control means 63 are connected to the liquid crystal panel 40 in series. The output signals of the time modulation means 62 form the cell signals Sa, Sb and Sc which respectively determine the output tone levels of the cells 41*a*, 41*b* and 41*c* for the picture element 41.

The outputs of the time modulation means 62 may be directly input into the respective cells without providing the on-off control means 63.

As in the monochromatic image display systems 1 and 5 of the first and second embodiments, the tone corresponding to the input monochromatic image signal So is allotted to the cells by said uniform allotment method, the vector allotment method or the like.

Also in the monochromatic image display system 6 of this embodiment, when each picture element is expressed by M cells, the number of display tone levels which can be expressed by intensity modulation of each cell is set to L (but tone level 0) and the number of display tone levels which can be expressed by time modulation of each cell is set to N (but tone level 0), M×L×N+1 tones (tone level 0 inclusive) can be expressed in total. That is, by expressing each picture element of a monochromatic image by M cells, allotting the tone corresponding to the input monochromatic image signal So to the cells and carrying out intensity modulation and time modulation on each cell according to the allotted tone, the number of display tone levels can be multiplied to M×L×N+1 (tone level 0 inclusive) whereas the number of display tone levels obtained solely by intensity modulation and time modulation is only L×N+1 (tone level 0 inclusive).

Figure 9:
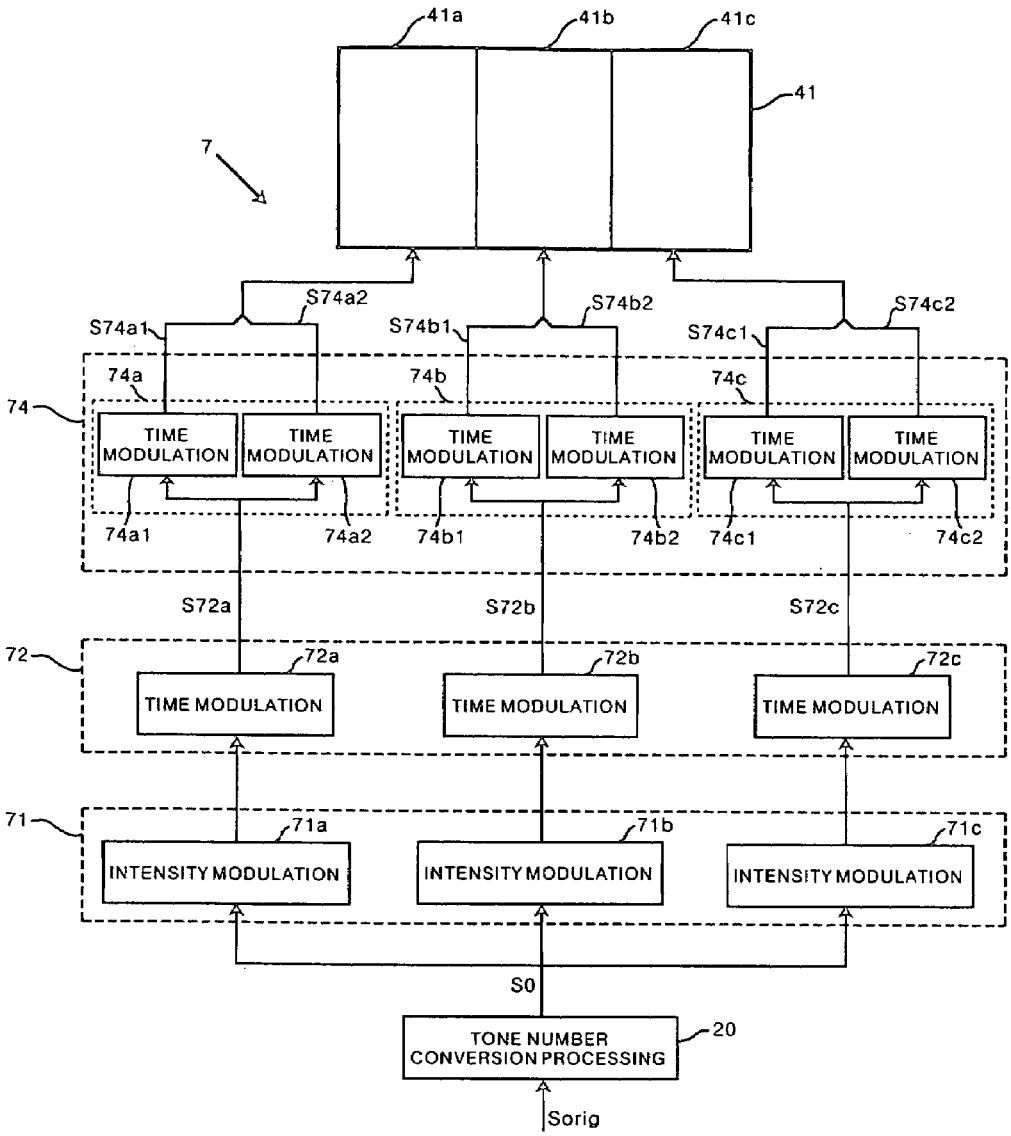
FIG. 9 is a block diagram showing the arrangement of a monochromatic image display system in accordance with a fourth embodiment of the present invention (area modulation+intensity modulation+time modulation by pulse width gradation control+time modulation by FRC) for one picture element of a liquid crystal panel.
Figures 10A, 10B, 10C, 10D:
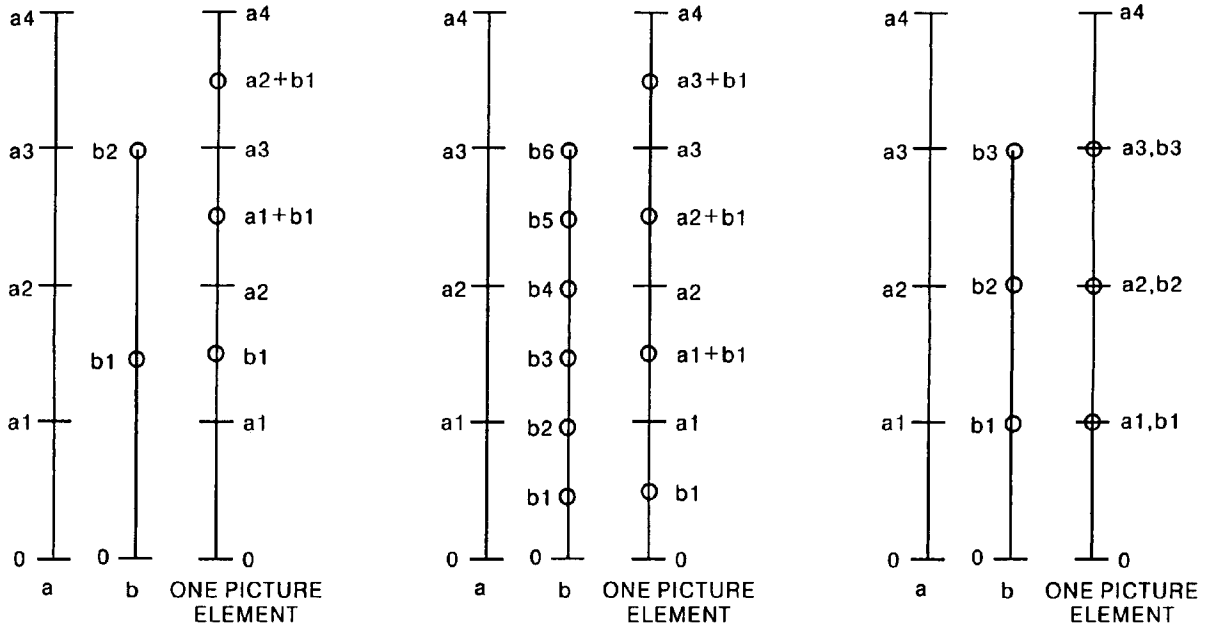
FIGS. 10A to 10D are views for illustrating a method of multiplying the number of display tone levels.
Figure 11B:
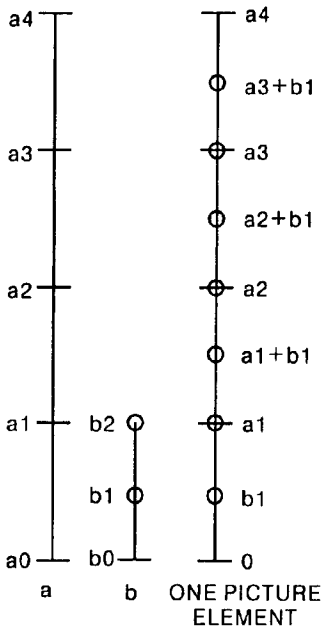
FIGS. 11A to 11D are views for illustrating another method of multiplying the number of display tone levels.
Figure 11C:
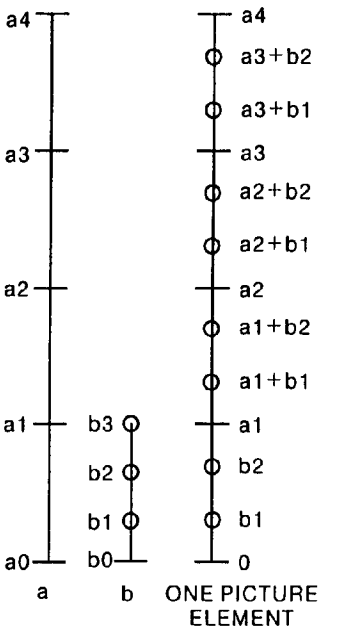
Figure 11D:
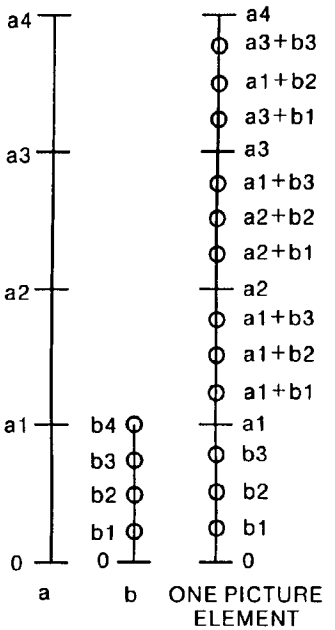
Figure 11A:
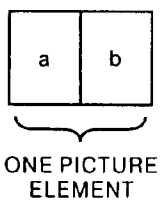
Figure 12:
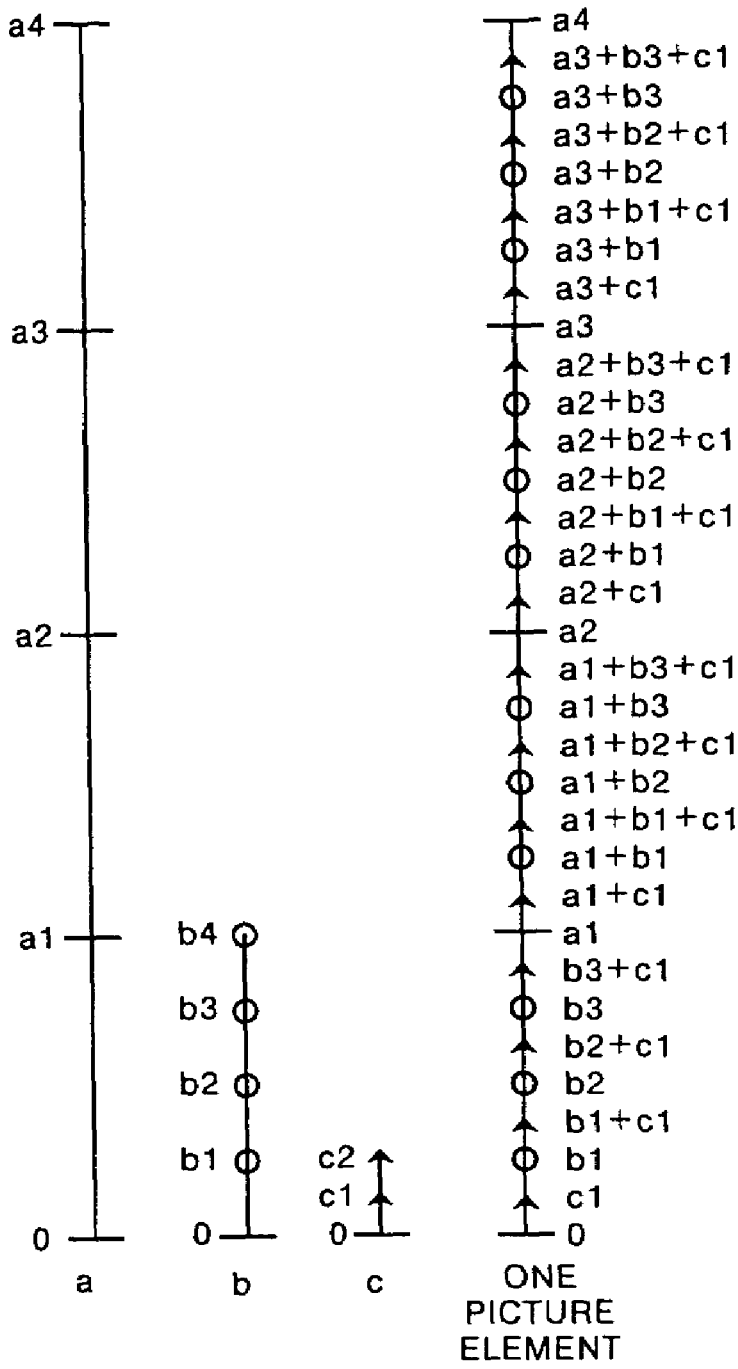
FIG. 12 is a view for illustrating still another method of multiplying the number of display tone levels.

A monochromatic image display system in accordance with a fourth embodiment of the present invention will be described with reference to FIG. 9, hereinbelow. FIG. 9 is a block diagram showing the arrangement of the monochromatic image display system in accordance with the fourth embodiment of the present invention for one picture element. As the display device, a liquid crystal panel 40 shown in FIG. 2 is employed.

The monochromatic image display system 7 of the fourth embodiment is substantially the same as the monochromatic image display system 6 of the third embodiment except that a FRC time modulation means 74 for carrying out FRC is added and in the monochromatic image display system 7 of the fourth embodiment, the number of display tone levels is multiplied by a combination of area modulation, intensity modulation, time modulation by pulse width gradation control and time modulation by FRC. As shown in FIG. 9, the monochromatic image display system 7 is provided for each picture element with a cell signal generating means 70 which comprises an intensity modulation means 71 which carries out intensity modulation on the basis of the monochromatic image signal So, a first time modulation means 72 which carries out pulse width gradation control on the output signals S71*a*, S71*b* and S71*c* of the intensity modulation means 71 and a second time modulation means 74 which carries out FRC on the output signals S72*a*, S72*b* and S72*c* of the first time modulation means 72.

The second time modulation means 74 comprises three time modulating sections 74*a*, 74*b* and 74*c* for the respective cells 41*a*, 41*b* and 41*c*, and the time modulating sections 74*a*, 74*b* and 74*c* respectively comprises pairs of time modulation sections 74*a*1 and 74*a*2, 74*b*1 and 74*b*2, and 74*c*1 and 74*c*2. The intensity modulation means 71, the first time modulation means 72 and the second time modulation means 74 are connected to the liquid crystal panel 40 in series in this order.

First frame signals S74*a*1, S74*b*1 and S74*c*1 and second frame signals S74*a*2, S74*b*2 and S74*c*2 output from the second time modulation means 74 are alternatively into the respective cells 41*a*, 41*b* and 41*c* for the picture element 41 frame by frame. That is, the frame signals 74*a*1 and 74*a*2 form the cell signal Sa, the frame signals 74*b*1 and 74*b*2 form the cell signal Sb and the frame signals 74*c*1 and 74*c*2 form the cell signal Sc.

As in the monochromatic image display systems 1, 5 and 6 of the first to third embodiments, the tone corresponding to the input monochromatic image signal So is allotted to the cells by said uniform allotment method, the vector allotment method or the like. It is preferred that the output tone level of each cell is determined by the intensity modulation means 71 and the time modulation means 72 so that the output luminances of the frames become substantially uniform.

In the monochromatic image display system 7 of this embodiment, when the number of display tone levels which can be expressed by FRC is set to F (but tone level 0), M×L×N×F+1 tones (tone level 0 inclusive) can be expressed in total.

Though the monochromatic image display system 7 of the fourth embodiment is obtained by adding a time modulation means 74 for carrying out FRC to the monochromatic image display system 6 of the third embodiment, such a time modulation means 74 may be added to the monochromatic image display system 1 of the first embodiment or the monochromatic image display system 5 of the second embodiment.

Concrete examples of allotting the output luminance of each picture element to the cells in monochromatic image display systems of the first aspect of the present invention will be described, hereinbelow.

Example 1 of Luminance Allotment

In this example, it is assumed that the number of cells for each picture element=3, the number of frames=1 (i.e., without FRC), the maximum number of tone levels which each cell can express per frame=64 (0 to 63), the original image is a CT image, and the original image signal Sorig=256 tone levels (0 to 255)=8 bits.

In this case, the maximum number of tone levels which can be expressed is 190 (63×3+1). Accordingly, the original image signal Sorig of 256 tone levels (0 to 255) is first converted to a monochromatic image signal So of 190 tone levels (0 to 189).

In the case where the output luminance of each picture element is to be allotted by the uniform allotment method under the condition that all the cells for each picture element emit light at the same luminance for a given input tone level, allotment is as shown in the following table 1.

TABLE 1

| So | Sa to cell a | Sa to cell b | Sa to cell c |
|---|---|---|---|
| 0 | 0 | 0 | 0 |
| 1 | 1 | 0 | 0 |
| 2 | 1 | 1 | 0 |
| 3 | 1 | 1 | 1 |
| 4 | 2 | 1 | 1 |
| . | . | . | . |
| . | . | . | . |
| . | . | . | . |
| 187 | 63 | 62 | 62 |
| 188 | 63 | 63 | 62 |
| 189 | 63 | 63 | 63 |

Example 2 of Luminance Allotment

In this example, it is assumed that the number of cells for each picture element=3, the number of frames=1 (i.e., without FRC), the maximum number of tone levels which each cell can express per frame=256 (0 to 255), the original image is a CT image, and the original image signal Sorig=256 tone levels (0 to 255)=8 bits.

In this case, the maximum number of tone levels which can be expressed is 766 (255×3+1). Accordingly, the original image signal Sorig of 256 tone levels (0 to 255) is first converted to a monochromatic image signal So of 766 tone levels (0 to 765).

In the case where the output luminance of each picture element is to be allotted by the uniform allotment method under the condition that all the cells for each picture element emit light at the same luminance for a given input tone level, allotment is as shown in the following table 2.

TABLE 2

| So | Sa to cell a | Sa to cell b | Sa to cell c |
|---|---|---|---|
| 0 | 0 | 0 | 0 |
| 1 | 1 | 0 | 0 |
| 2 | 1 | 1 | 0 |
| 3 | 1 | 1 | 1 |
| 4 | 2 | 1 | 1 |
| . | . | . | . |
| . | . | . | . |
| . | . | . | . |

TABLE 2-continued

| So | Sa to cell a | Sa to cell b | Sa to cell c |
|---|---|---|---|
| 763 | 255 | 254 | 254 |
| 764 | 255 | 255 | 254 |
| 765 | 255 | 255 | 255 |

Example 3 of Luminance Allotment

In this example, it is assumed that the number of cells for each picture element=3, the number of frames=1 (i.e., without FRC), the maximum number of tone levels which each cell can express per frame=256 (0 to 255), the original image is a CR image, and the original image signal Sorig=1024 tone levels (0 to 1023)=10 bits.

In this case, the maximum number of tone levels which can be expressed is 766 (255×3+1). Accordingly, the original image signal Sorig of 1024 tone levels (0 to 1023) is first converted to a monochromatic image signal So of 766 tone levels (0 to 765).

In the case where the output luminance of each picture element is to be allotted by the uniform allotment method under the condition that all the cells for each picture element emit light at the same luminance for a given input tone level, allotment is as shown in the following table 3.

TABLE 3

| So | Sa to cell a | Sa to cell b | Sa to cell c |
|---|---|---|---|
| 0 | 0 | 0 | 0 |
| 1 | 1 | 0 | 0 |
| 2 | 1 | 1 | 0 |
| 3 | 1 | 1 | 1 |
| 4 | 2 | 1 | 1 |
| . | . | . | . |
| . | . | . | . |
| . | . | . | . |
| 763 | 255 | 254 | 254 |
| 764 | 255 | 255 | 254 |
| 765 | 255 | 255 | 255 |

Example 4 of Luminance Allotment

In this example, it is assumed that the number of cells for each picture element=3, the number of frames=2 (i.e., with FRC), the maximum number of tone levels which each cell can express per frame=256 (0 to 255), the original image is a CR image, and the original image signal Sorig=1024 tone levels (0 to 1023)=10 bits.

In this case, the maximum number of tone levels which can be expressed is 1531 (255×3×2+1). Accordingly, the original image signal Sorig of 1024 tone levels (0 to 1023) is first converted to a monochromatic image signal So of 1531 tone levels (0 to 1530).

In the case where the output luminance of each picture element is to be allotted by the uniform allotment method under the condition that all the cells for each picture element emit light at the same luminance for a given input tone level, allotment is as shown in the following table 4. When the signal allotted to each cell is to be uniformly allotted to the frames, allotment is as shown in the following table 5.

TABLE 4

| So | Sa to cell a | Sa to cell b | Sa to cell c |
|---|---|---|---|
| 0 | 0 | 0 | 0 |
| 1 | 1 | 0 | 0 |
| 2 | 1 | 1 | 0 |
| 3 | 1 | 1 | 1 |
| 4 | 2 | 1 | 1 |
| . | . | . | . |
| . | . | . | . |
| . | . | . | . |
| 1528 | 510 | 509 | 509 |
| 1529 | 510 | 510 | 509 |
| 1530 | 510 | 510 | 510 |

TABLE 5

| So | signal to frame 1 | signal to frame 2 |
|---|---|---|
| 0 | 0 | 0 |
| 1 | 1 | 0 |
| 2 | 1 | 1 |
| 3 | 2 | 1 |
| 4 | 2 | 2 |
| . | . | . |
| . | . | . |
| . | . | . |
| 508 | 254 | 254 |
| 509 | 255 | 254 |
| 510 | 255 | 255 |

The first to fourth embodiments described above are in accordance with the first aspect of the present invention. As can be seen from the description above, in accordance with the first aspect of the present invention, since a display device which can express each picture element of a monochromatic image by a series of cells each of which can express tones in multiple levels is employed, and area modulation where each picture element of the monochromatic image is expressed by a plurality of cells is carried out as well as intensity modulation and/or time modulation on each cell to determine the output tone level of each cell, the number of tones which can be expressed is greatly multiplied, whereby a monochromatic image which is rich in expression can be displayed.

Embodiments of the second aspect of the present invention will be described hereinbelow.

Figure 13:
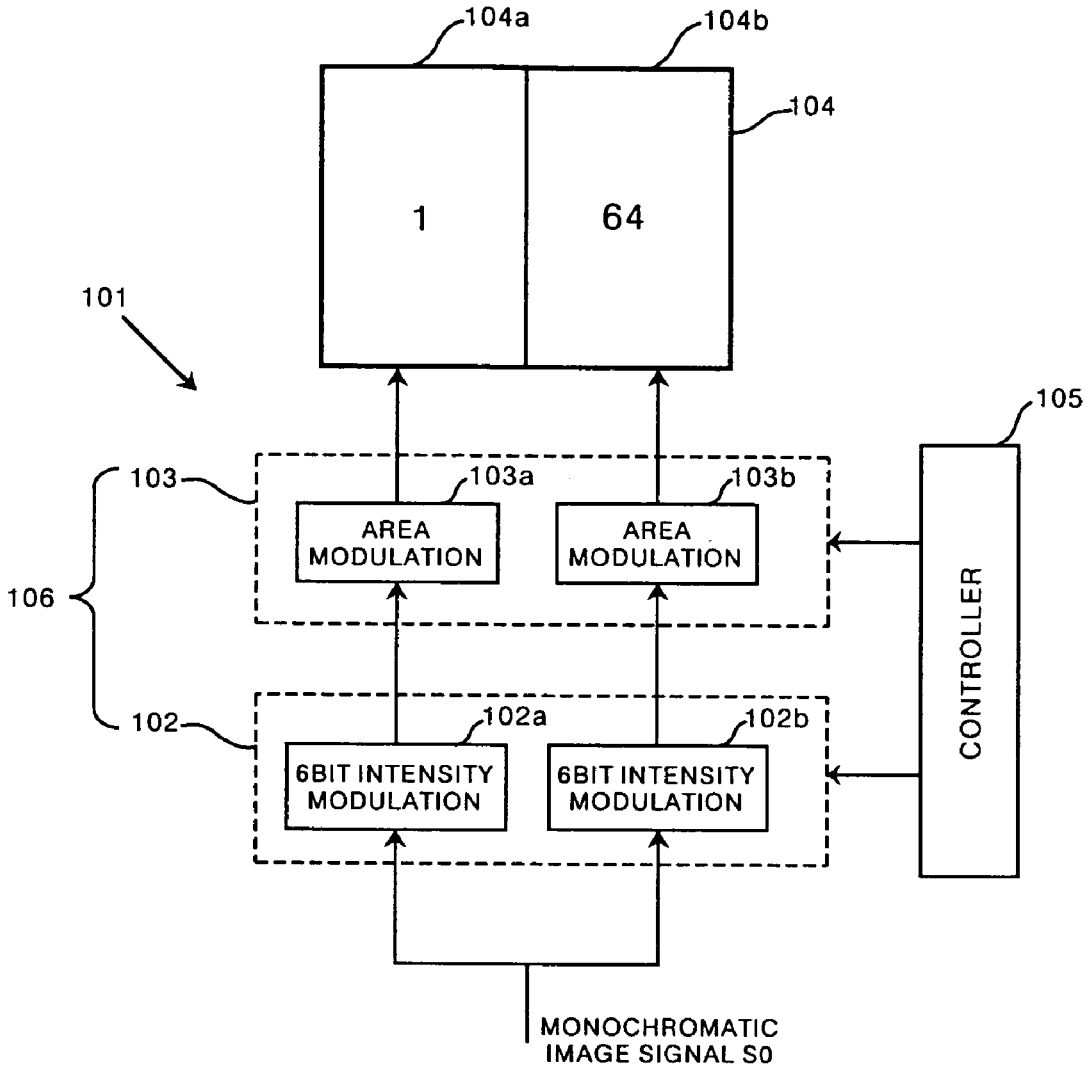
FIG. 13 is a block diagram showing the arrangement of a monochromatic image display system in accordance with a fifth embodiment of the present invention for one picture element of a liquid crystal panel.

FIG. 13 is a block diagram showing the arrangement of a monochromatic image display system 101 in accordance with a fifth embodiment of the present invention for one picture element. In the monochromatic image display system 101 of this embodiment, a display device 104 in which each picture element 104 is expressed by a pair of cells 104*a* and 104*b* is employed. The maximum output level of the cells 104*a* and 104*b* are 1 and 65, respectively.

The monochromatic image display system 101 comprises a drive means 106 including an intensity modulation means 102 (comprising intensity modulating sections 102*a* and 102*b* respectively for the cells 104*a* and 104*b*) which controls electric voltages to be imparted to the cells 104*a* and 104*b* in 6 bits or 64 levels (63 levels but level 0) on the basis of a monochromatic image signal So and an area modulation means 103 (comprising area modulating sections 103*a* and 103*b* respectively for the cells 104*a* and 104*b*) which turns on and off outputs of the intensity modulating sections 102*a* and 102*b* of the intensity modulation means 102 independently of each other, thereby controlling signal input into the cells, and a controller 105 which controls on the basis of the monochromatic image signal So the intensity modulation means 102 and the area modulation means 103 so that the display tone of the picture element 104 becomes a desired level. When the electric voltages imparted to the cells are controlled by the intensity modulation means 102, the display tone levels of the respective cells are changed. Since the tone of the cell 104*b* is controlled in 63 levels by the intensity modulating section 102*b*, the output level difference per one level of the cell 104*b* is 1/63 of the maximum output level of the cell 104*b*, and the maximum output level of the cell 104*a* is 1/64 of that of the cell 104*b*. Accordingly, the output level difference per one level of the cell 104*b* is substantially equal to the maximum output level of the cell 104*a*. More strictly, the maximum output level of the cell 104*a* is smaller than the output level difference per one level of the cell 104*b* by the output level difference per one level of the cell 104*a* as can be understood from FIG. 14.

Figure 14:
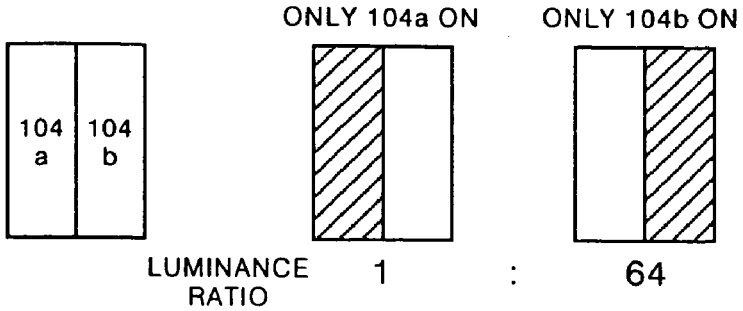
FIG. 14 is a view for illustrating the number of display tone levels of the monochromatic image display system shown in FIG. 13.

FIG. 14 shows the number of display tone levels of the monochromatic image display system 101 of this embodiment. As can be seen from FIG. 14, the number of the display tone levels as viewed as a picture element can be the sum of the number of the display tone levels by the cell 104*b* and the number of the display tone levels by the cell 104*a* which intervene between two adjacent display tone levels of the cell 104*b*. Accordingly, in this example, since the tones of the cells 104*a* and 104*b* are both controlled in 6 bits respectively by the intensity modulating sections 102*a* and 102*b*, the number of the display tone levels as viewed as a picture element can be 6 bits (64)×6 bits (64) (=4096) in total.

Figure 15:
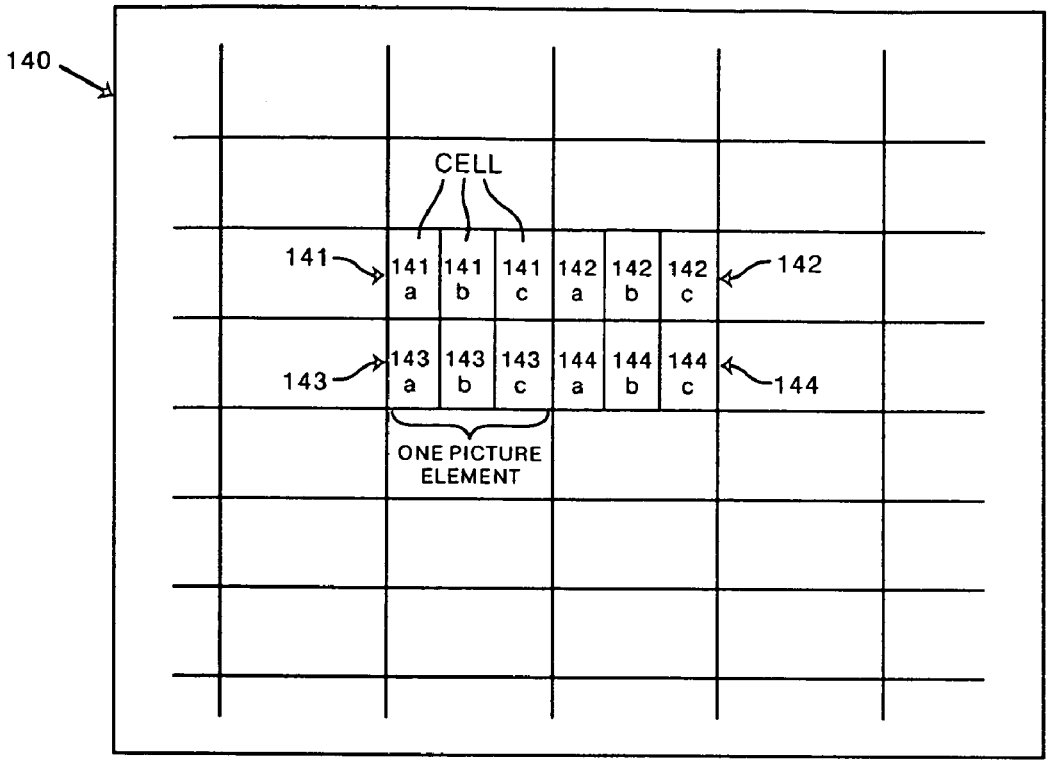
FIG. 15 is a view showing the picture element arrangement of a liquid crystal panel employed in a monochromatic image display system in accordance with a sixth embodiment of the present invention.
Figure 16:
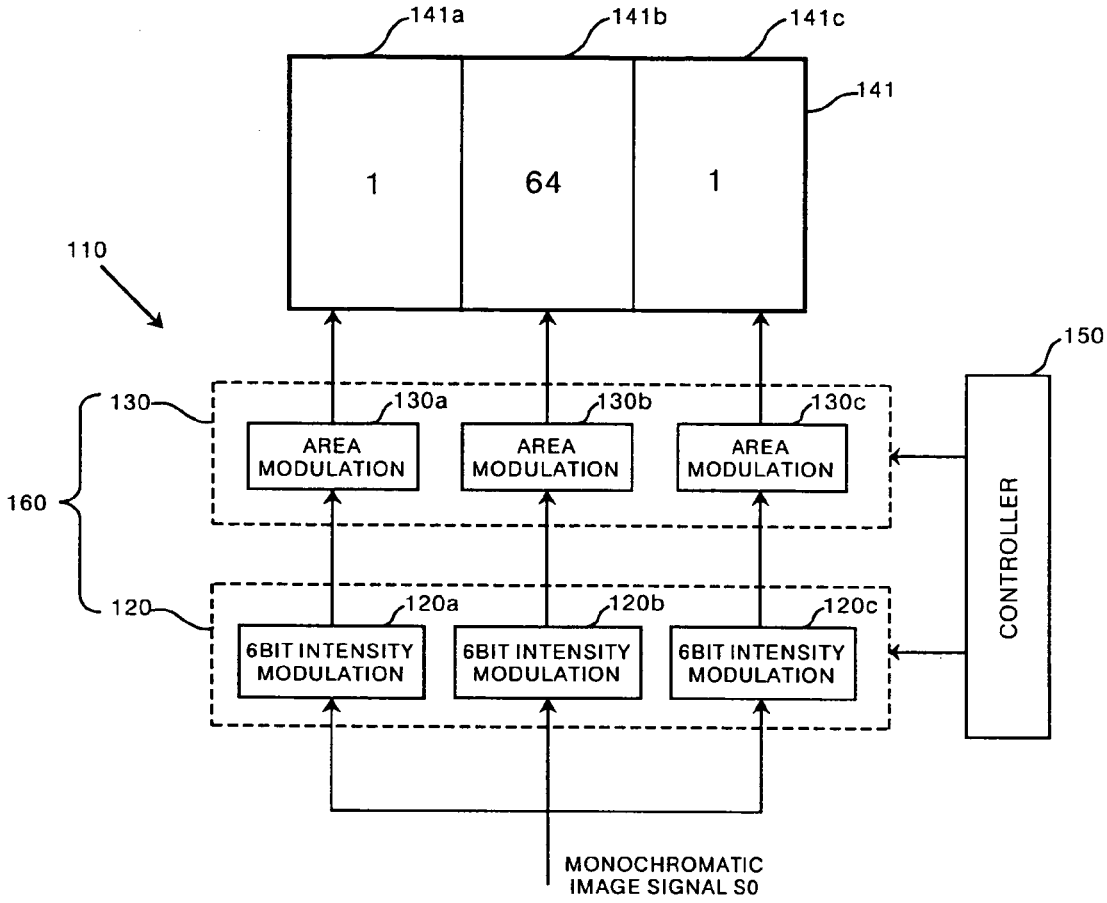
FIG. 16 is a block diagram showing the arrangement of the monochromatic image display system in accordance with the sixth embodiment of the present invention for one picture element of the liquid crystal panel.

A monochromatic image display system 110 in accordance with a sixth embodiment of the present invention will be described with reference to FIGS. 15 and 16, hereinbelow. In the monochromatic image display system 110 of this embodiment, a liquid crystal panel 140 in which each picture element is expressed by three cells is employed. The liquid crystal panel 140 is formed by replacing color filters of a color liquid crystal panel by a monochromatic filter formed on two of the three cells and another monochromatic filter of different transmittance formed on the other cell. FIG. 15 is a view showing an example of the picture element arrangement in the liquid crystal panel 140. As shown in FIG. 15, each of picture elements 141, 142, 143, 144 and the like is expressed by three cells (e.g., cells 141*a*, 141*b* and 141*c* for the picture element 141). The maximum output levels of the cells a and b are 1 and that of the cell c is 64.

The monochromatic image display system 110 comprises a drive means 160 including an intensity modulation means 120 (comprising intensity modulating sections 120*a*, 120*b* and 120*c* respectively for the cells 141*a*, 141*b* and 141*c*) which controls electric voltages to be imparted to the cells 141*a*, 141*b* and 141*c* in 6 bits or 64 levels on the basis of a monochromatic image signal So and an area modulation means 130 (comprising area modulating sections 130*a*, 130*b* and 130*c* respectively for the cells 141*a*, 141*b* and 141*c*) which turns on and off outputs of the intensity modulating sections 120*a*, 120*b* and 120*c* of the intensity modulation means 120 independently of each other, thereby controlling signal input into the cells, and a controller 150 which controls on the basis of the monochromatic image signal So the intensity modulation means 120 and the area modulation means 130 so that the display tone of the picture element 141 becomes a desired level. The intensity modulating means 120*a* for the cell 141*a* uses the uppermost one bit only to give level 32 and carries out the control substantially only by the other five bits. The intensity modulating means 120*c* for the cell 141*c* does not use the uppermost one bit and actually carries out the control by the other five bits. The maximum output level of the cell 141*b* is 64 times as high as those of the cells 141*a* and 141*c*. Since the tone of the cell 141*b* is controlled in 64 levels by the intensity modulating section 120*b*, the output level difference per one level of the cell 141*b* is 1/64 of the maximum output level of the cell 141*b*. Accordingly, the output level difference per one level of the cell 141*b* becomes substantially equal to the combination of the output levels of the cells 141*a* and 141*c* when the combinations of the display tone levels of the cells 141*a* and 14*c* are controlled in 64 levels as will be described later.

Figure 17:
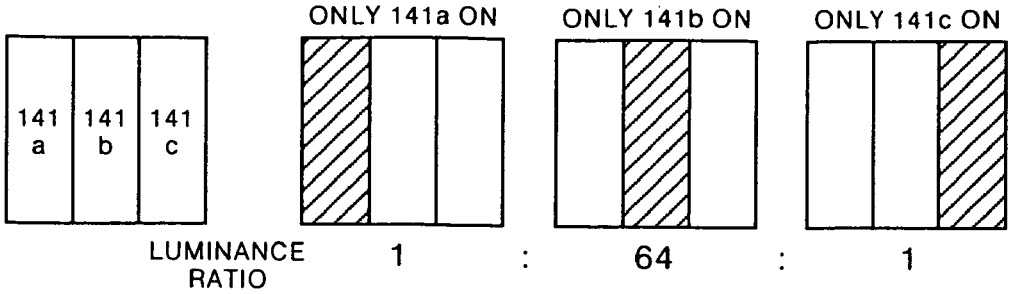
FIG. 17 is a view for illustrating the number of display tone levels of the monochromatic image display system shown in FIG. 16.

FIG. 17 shows the number of display tone levels of the monochromatic image display system 110 of this embodiment. As can be seen from FIG. 17, the number of the display tone levels as viewed as a picture element can be the sum of the number of the display tone levels by the cell 141*b* and the number of the display tone levels obtained by combinations of the display tone levels of the cells 141*a* and 141*c* which intervene between two adjacent display tone levels of the cell 104*b*. Since the number of the tone levels obtained by combinations of the display tone levels of the cell 141*a* (32 levels and 0 level) and those of the cell 141*c* (31 levels and 0 level) is 64 and each of 64 display tone levels of the cell 14*ab* is divided into 64, the number of the display tone levels as viewed as a picture element can be 64×64 (=4096) in total.

When each picture element is expressed by three cells, each picture element can be expressed in a larger number of tones by making at least two of the cells have maximum out levels different from each other and making the output level differences per one level of the cells differ from each other.

Figure 18:
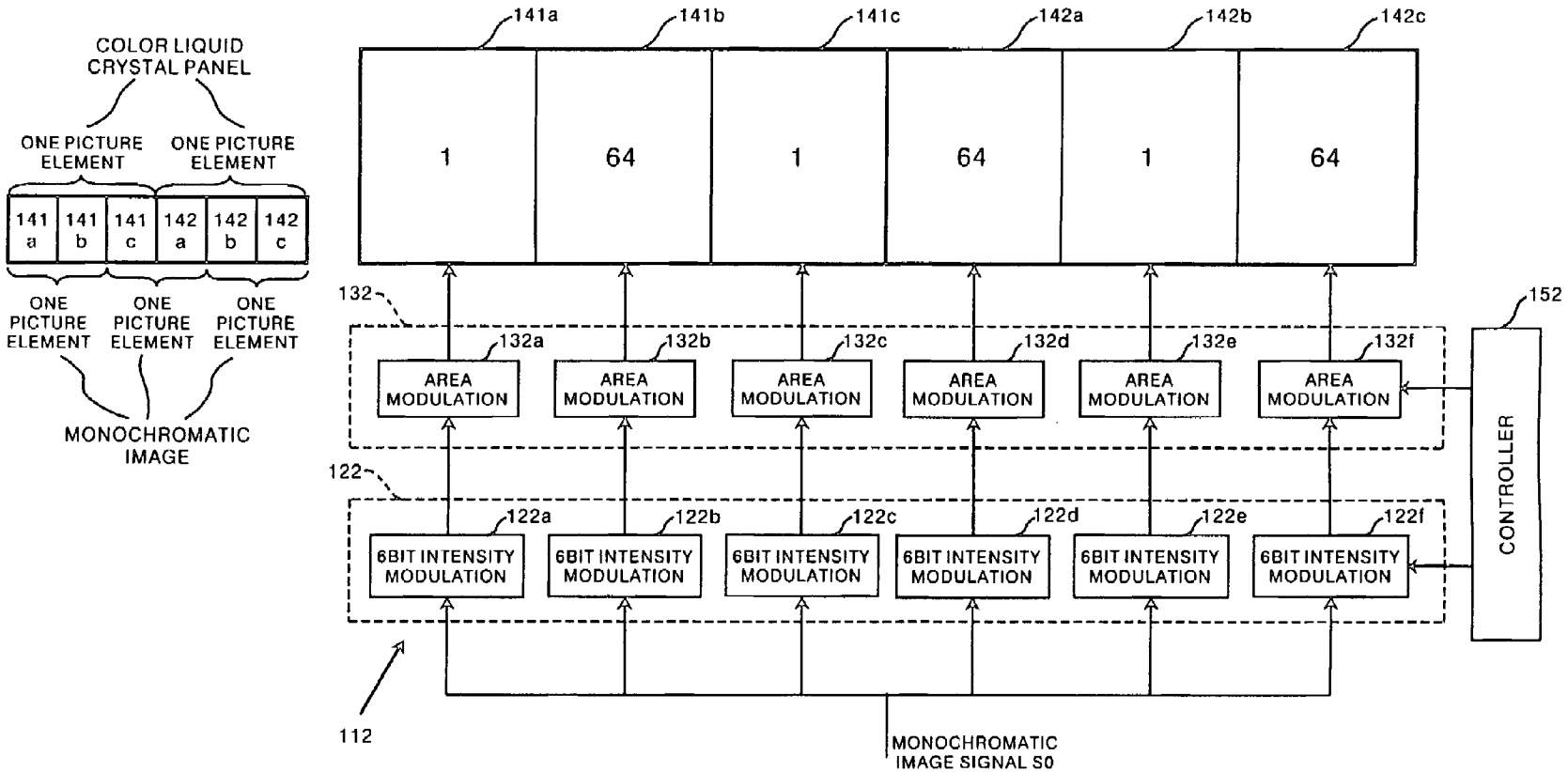
FIG. 18 is a block diagram showing the arrangement of the monochromatic image display system in accordance with a seventh embodiment of the present invention for a pair of picture elements of a color liquid crystal panel.

Further, since 4096 display tone levels can be obtained by combination of two cells which are 1 and 64, respectively, in the maximum output levels as shown in FIG. 14, resolution can be improved by expressing three picture elements of the monochromatic image by use of six cells which are used to express two picture elements in a color liquid crystal panel as in the seventh embodiment shown in FIG. 18. That is, in the monochromatic image display system 112 shown in FIG. 18, for example, six cells 141*a*, 141*b*, 141*c*, 142*a*, 142*b* and 142*c* for picture elements 141 and 142 of the liquid crystal panel 140 shown in FIG. 15 are used to express three picture elements of the monochromatic image. The cells 141*a*, 141*c* and 142*b* are 1 in the maximum output level and controlled by area modulating sections 132*a*, 132*c* and 132*e*, and the cells 141*b*, 142*a* and 142*c* are 64 in the maximum output level and controlled by area modulating sections 132*b*, 132*d* and 132*f*. All the area modulating sections are controlled in 6 bits.

Figure 19:
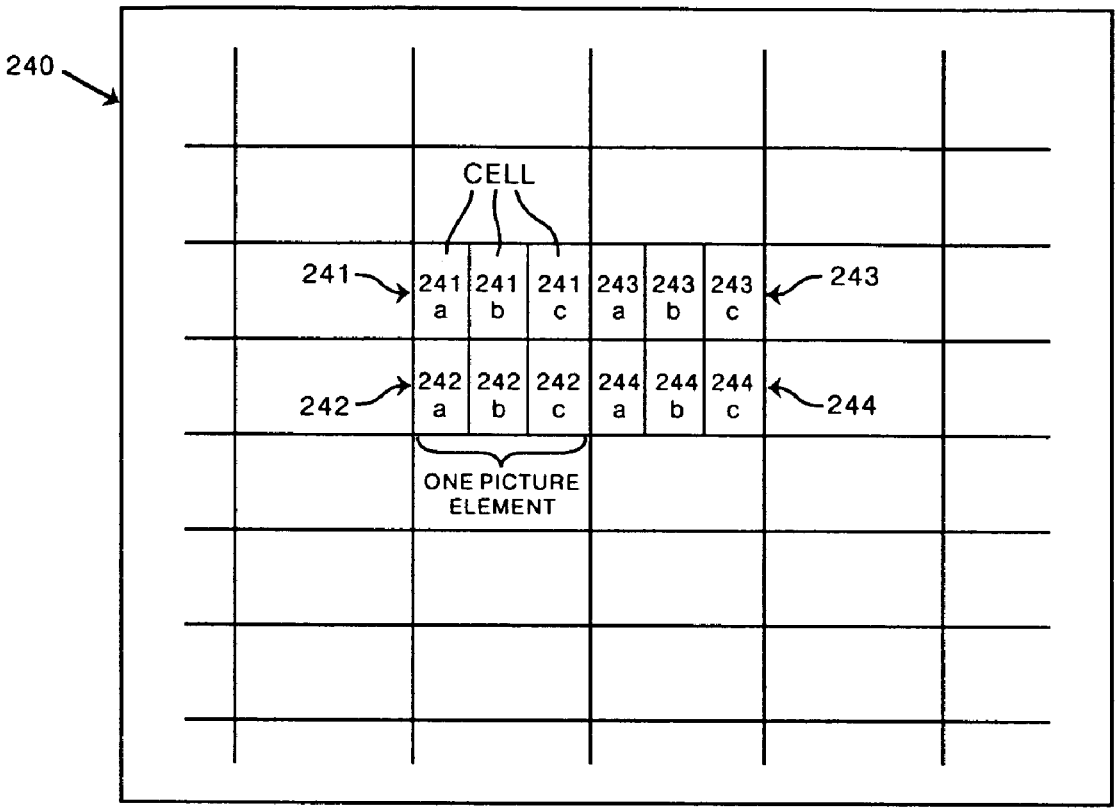
FIG. 19 is a view showing the picture element arrangement of a liquid crystal panel employed in a flat panel display system in accordance with an eighth embodiment of the present invention.
Figure 21:
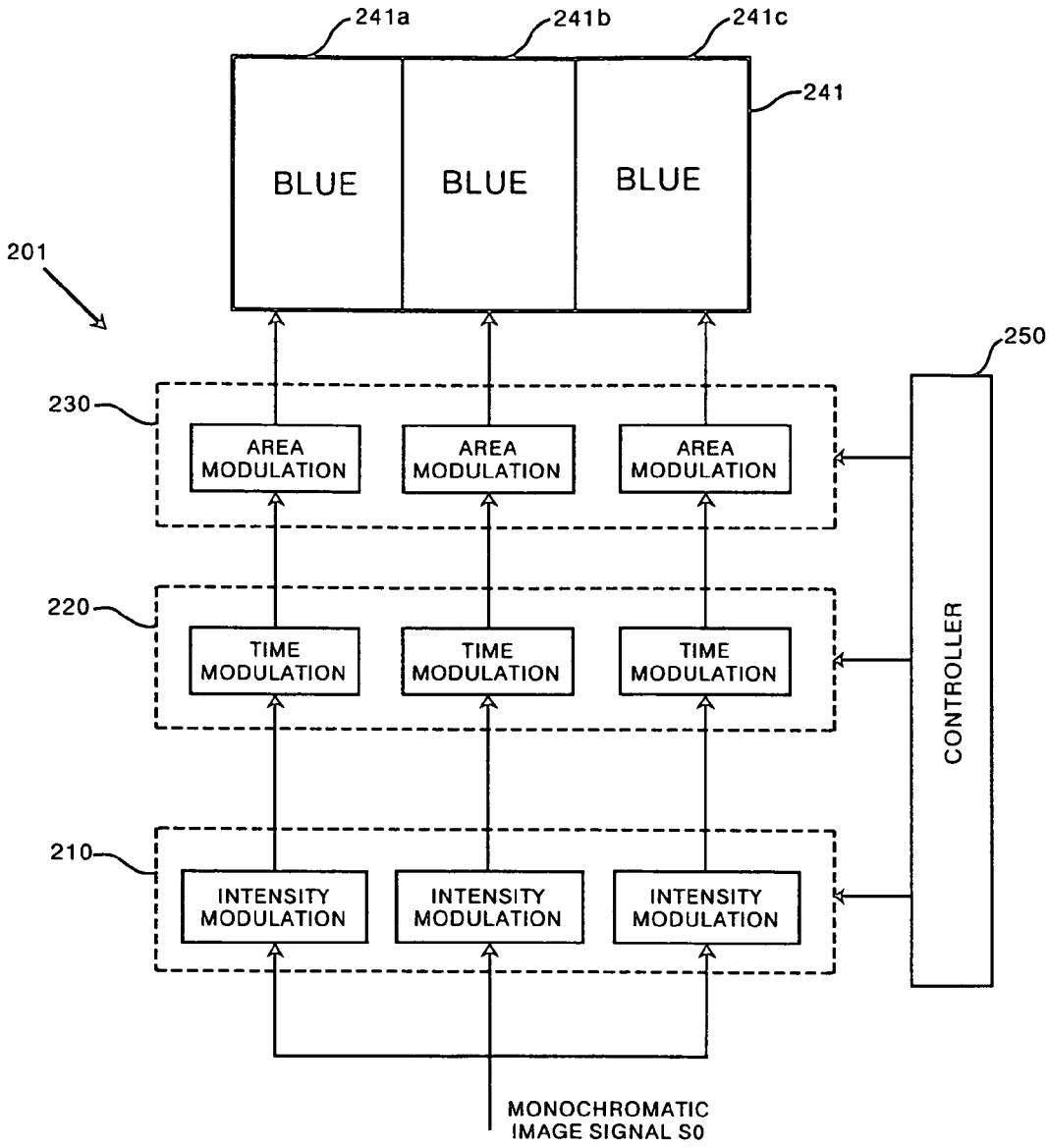
FIG. 21 is a block diagram showing the arrangement of the flat panel display system for one picture element of the liquid crystal panel.

Embodiments of the third aspect of the present invention will be described, hereinbelow. In FIG. 21, a flat panel display system 201 in accordance with an eighth embodiment of the present invention is provided with a liquid crystal panel 240 shown in FIG. 19. The liquid crystal panel 240 is formed by replacing color filters of a color liquid crystal panel by monochromatic filters and can express each picture element of a monochromatic image by three cells. FIG. 19 is a view showing the picture element arrangement of the liquid crystal panel 240. The liquid crystal panel 240 can express each picture element of a monochromatic image by three cells as shown in FIG. 19. For example, each of picture elements 241, 242, 243, 244 and the like can be expressed by three cells (e.g., cells 241*a*, 241*b* and 241*c* for the picture element 241).

Figure 20:
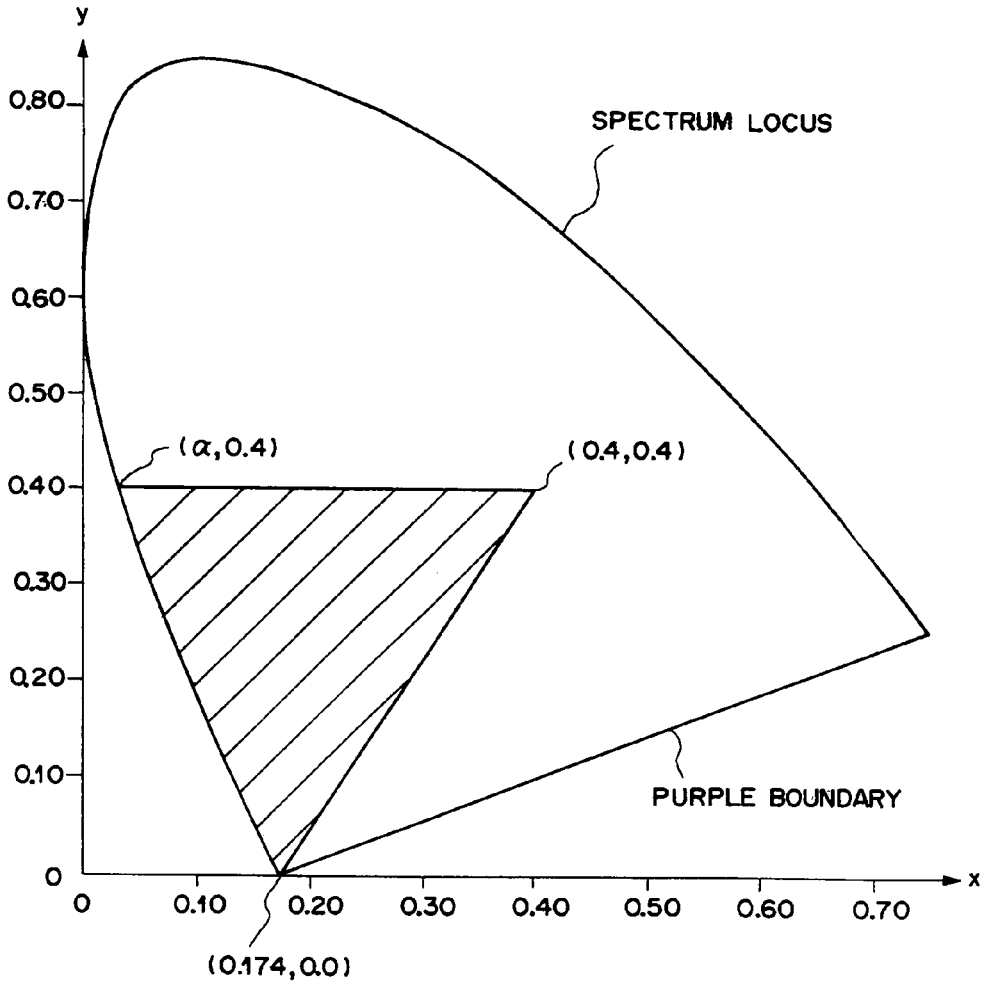
FIG. 20 is a CIE chromaticity diagram showing the range of the displaying color of the liquid crystal panel.

The liquid crystal panel 240 is provided with a monochromatic filter on all the cells so that its displaying color, including back light emitted from, for instance, a high-luminance halogen lamp (not shown), falls within the region surrounded by points (0.174, 0), (0.4, 0.4) and (α, 0.4) as represented by co-ordinates (x, y) on a CIE chromaticity diagram shown in FIG. 20, wherein α represents the x-co-ordinate of the intersection of a spectrum locus and a straight line y=0.4. Point (0.174, 0) is a shorter wavelength side end of the spectrum locus. The region surrounded by these three points (the dashed region) is a blue region.

The monochromatic filter is preferably a filter colored to blue. Since the display luminance need not be determined taking into account color display, the transmittance of the filter may be freely selected and accordingly a blue series monochromatic filter high in transmittance can be employed. In the liquid crystal panel 240, the maximum luminance of each picture element, including back light, is set in the range of 100 cd/m$^2$ to 10000 cd/m$^2$ so that a monochromatic image can be displayed at a luminance in the range of 50 to 500 cd/m$^2$, where the brightness discriminating ability and the sight are optimized, by various modulations to be described later.

The display device need not be limited to the liquid crystal panel but an organic EL panel comprising an array of organic ELs which emit light in a color which falls within the aforesaid region may also be used. In this case, the maximum luminance of each picture element can be set in the range of 100 cd/m$^2$ to 10000 cd/m$^2$ by increasing a drive current to each organic EL, or by increasing luminance of the cells by material development.

As shown in detail for picture element 241 in FIG. 21, the flat panel display system 201 comprises an intensity modulation means 210 which controls electric voltages to be imparted to the cells 241*a*, 241*b* and 241*c* on the basis of a monochromatic image signal So, a time modulation means 220 which carries out tone control by FRC on an output of the intensity modulation means 210 for each cell, an area modulation means 230 which turns on and off outputs of the time modulation means 220 independently of each other, thereby controlling signal input into the cells, and a controller 250 which controls the intensity modulation means 210, the time modulation means 220 and the area modulation means 230 so that unevenness in density is not generated in each picture element. With this arrangement, the number of display tone levels and the maximum luminance as viewed as a picture element can be increased by a combination of area modulation and time modulation. By controlling the electric voltage to be imparted to each cell by the intensity modulation means 210, the display density or the display tone level of each cell can be changed in a plurality of levels, which is 8 bits, 256 levels, in this particular embodiment.

FIG. 22 is a view for illustrating the operation of the time modulation means 220. The time modulation means 220 is connected to each of the cells of the liquid crystal panel 240 by way of the area modulation means 230.

In this embodiment, the time modulation means 220 divides a unit time into four time segments and carries out a time division drive in which the input signal is selectively turned on and off by the time segment. Then an output signal of the time modulation means 220 is input into the area modulation means 230 corresponding to each cell. Accordingly when the input signal is turned on for only one time segment, tone level 1 is expressed, and when the input signal is turned on for two time segments, tone level 2 is expressed. Thus four tone levels (but tone level 0) can be expressed in total by each cell.

The area modulation means 230 turns on and off the output signals input into the respective cells from the time modulation means 220 independently of each other. Since each picture element of the liquid crystal panel 240 is expressed by three cells, the number of the display tone levels for each picture element can be 256×4×3 (=3072) when the number of display tone levels which can be expressed by intensity modulation of each cell is 256. Further, the maximum display luminance for each picture element is the number of the cells times the maximum luminance of each cell, i.e., three times in this embodiment. When each picture element of a monochromatic image is expressed by M cells and the numbers of display tone levels which can be expressed respectively by intensity modulation and time modulation of each cell are L and N, the number of display tone levels can be multiplied to L×M×N, and the maximum display luminance for each picture element is increased to M times the maximum luminance of each cell.

Thus in the flat panel display system 201 of this embodiment, by a combination of area modulation, time modulation and intensity modulation, the number of the display tone levels is multiplied and at the same time, the maximum luminance of each picture element is set in the range of 100 cd/m$^2$ to 10000 cd/m$^2$ so that a monochromatic image can be displayed at a luminance in the range of 50 to 500 cd/m$^2$, where the brightness discriminating ability and the sight are optimized. Accordingly, when the flat panel display system 201 is employed as a medical image display system for a CR apparatus or the like, an image which are sufficient for medical applications in quality can be displayed.

It is preferred that density be allotted to the cells for each picture element as uniformly as possible so that unevenness in density is not generated in each picture element. FIGS. 23A and 23B are views for illustrating methods of allotting density to the cells. FIG. 23A shows a case where the density level is 3. As shown in FIG. 23A, in such a case, it is preferred that the density level be not allotted to the cells as [3, 0, 0] but uniformly allotted to the cells as [1, 1, 1]. In the case where the density level is 4, it is preferred that the density level be not allotted to the cells as [4, 0, 0] but allotted to the cells as uniformly as possible as [2, 1, 1], [1, 2, 1] or [1, 1, 2] as shown in FIG. 23B. The controller 250 carries out such allotment by controlling the intensity modulation means 210, the time modulation means 220 and the area modulation means 230.

Though, in the flat panel display system 201 of the embodiment described above, the number of the display tone levels is multiplied and the maximum luminance of each picture element is increased by a combination of area modulation, time modulation and intensity modulation, the flat panel display system of the third aspect of the present invention may be provided with only one of such functions. For example, the flat panel display system of the third aspect of the present invention may be provided with a combination of area modulation and time modulation or a combination of area modulation and intensity modulation.

As described above, the liquid crystal panel 240 is formed by replacing color filters of a color liquid crystal panel by monochromatic filters and can express each picture element of a monochromatic image by three cells. This will be described, hereinbelow. In a color liquid crystal panel, each picture element is expressed by three cells which are respectively provided with R (red), G (green) and B (blue) filters. A blue-base monochromatic liquid crystal panel in which each picture element of a monochromatic image is expressed by three cells can be obtained by changing all the R, G and B filters to B filters. Accordingly, by changing the color filter producing step in the color liquid crystal panel manufacturing steps to a B filer producing step, a blue base monochromatic liquid crystal panel which can be employed in this embodiment can be obtained. By this method, a blue base monochromatic liquid crystal panel can be manufactured more easily at lower cost as compared with manufacturing it by adding a B filter producing step to the monochromatic liquid crystal panel manufacturing steps. Further, in the recently available liquid crystal panels, color liquid crystal panels are less expensive than monochromatic liquid crystal panels.

Further the controller for controlling the tone of the liquid crystal panel may be an existing color liquid crystal panel driver, and the tone of a monochromatic image can be easily controlled by controlling the R, G and B inputs by use of the existing color liquid crystal panel driver.

The flat panel display system of the third aspect of the present invention need not be limited to the embodiment described above provided that the displaying color falls within the region surrounded by points (0.174, 0), (0.4, 0.4) and (α, 0.4) as represented by co-ordinates (x, y) on a CIE chromaticity diagram.

For example, though, in the embodiment described above, a liquid crystal panel is formed by replacing color filters of a color liquid crystal panel by bluish monochromatic filters, a display device whose components are colored to a predetermined color may also be employed.

Figure 24:
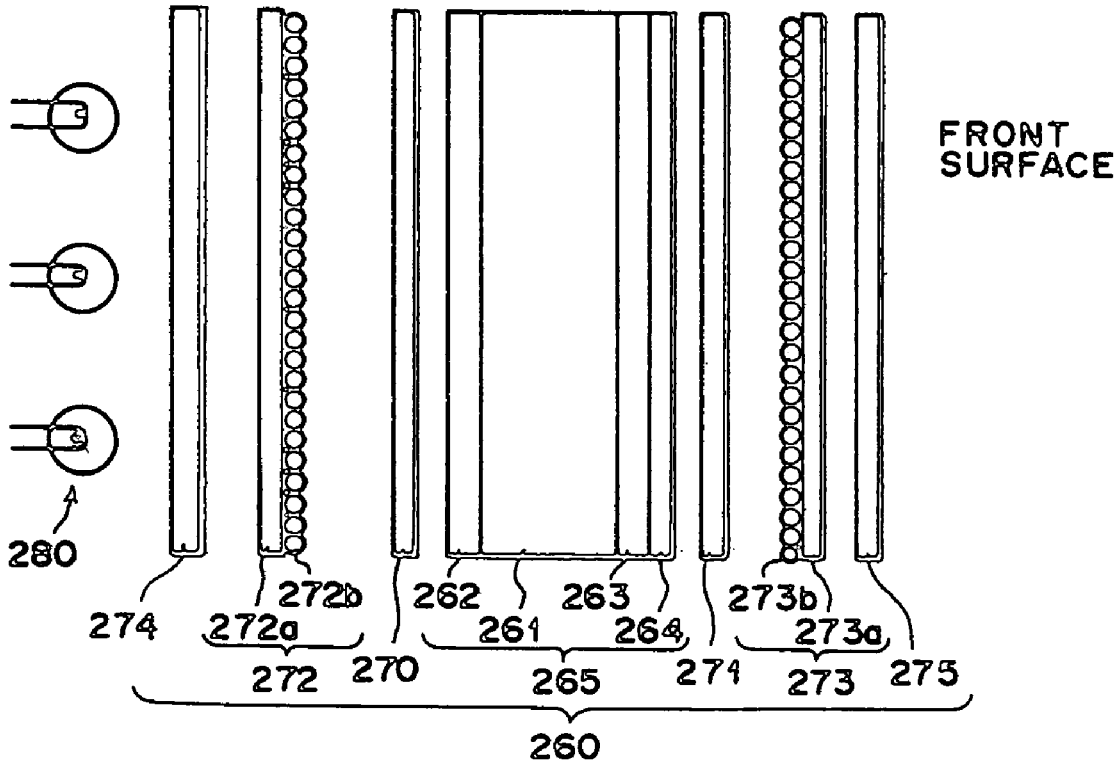
FIG. 24 is a view showing in brief components of a liquid crystal panel.

FIG. 24 shows typical components of a color liquid crystal panel. As shown in FIG. 24, back light sources 280 are disposed on the rear side of a color liquid crystal panel 260. The liquid crystal panel 260 comprises a pair of glass substrates 262 and 263 disposed on opposite sides of a liquid crystal layer 261 and RGB color filters 264 formed on the glass substrate 263. These elements form a main portion 265 of the panel 266. A pair of polarizing films 270 and 271 are respectively disposed on opposite sides of the main portion 265. A collimator film 272 is disposed between the polarizing film 270 and the light sources 280 and a diffuser film 273 is disposed outside the polarizing film 271. Further a diffuser panel 274 for diffusing light emitted from the light sources 280 is disposed between the collimator film 272 and the light sources 280. A face plate 275 provided with a protective layer is disposed on the front side of the diffuser film 273. The diffuser film 273 and the collimator film 272 are for increasing the angle of view. The RGB color filters 264 are for color display and are not provided when the liquid crystal panel is for black and white display.

The collimator film 272 may be replaced by a prism film for increasing luminance.

The light sources 280 are generally daylight fluorescent lamps of 5700° K to 7100° K though lamps of other color temperatures including a wavelength in a blue region may also be employed.

The monochromatic display device whose displaying color falls within the region surrounded by points (0.174, 0), (0.4, 0.4) and (α, 0.4) as represented by co-ordinates (x, y) on a CIE chromaticity diagram can be obtained also by coloring at least one of the glass substrates 262 and 263, the polarizing films 2720, 271,the collimator portion 272*b* and the base film 272*a* of the collimator film 272, the diffuser portion 273*b* and the base film 273*a* of the diffuser film 273, the diffuser panel 274, the face plate 275 to a predetermined color, preferably in a blue region.

When one or more of the components other than the RGB color filters 264 is colored, the RGB color filters 264 are removed. When a prism film is provided in place of the collimator film 272, the prism portion and/or the base film of the prism film may be colored.

For example, when the base film is of polyethylene terephthalate, the base film can be colored to a color in blue region by anthraquinone dye.

Also an organic EL panel whose displaying color falls in the aforesaid region can be obtained by coloring the components such as the substrate, the face plate and the like.

What is claimed is:

1. A monochromatic image display system comprising:

a display device comprising a plurality of picture elements, each picture element comprising a series of spatially adjacent cells, arranged in a linear manner, each cell emitting light in a same color and expressing tones in three or more levels; and a cell signal generating means which generates, based on a monochromatic image signal indicating an output luminance of each picture element of a monochromatic image, a cell signal for each spatially adjacent cell of a respective picture element of said display device, said cell signal determining an output tone level of the cell, so that an average of the output luminance of all the cells within each respective picture element correspond to an output luminance of the respective picture element, wherein each respective picture element of said display device corresponds to a picture element of said monochromatic image, and wherein the output luminance of the plurality of picture elements of said display device express said monochromatic image.

2. A monochromatic image display system as defined in claim 1 in which the cell signal generating means generates cell signals so that the output luminances of the cells of the respective picture element of said display device are substantially uniform.

3. A monochromatic image display system as defined in claim 1 in which the cell signal generating means generates cell signals so that the output luminances of the cells of the respective picture element of the display device change at an inclination according to a tone gradient vector of picture elements around the respective picture element corresponding to the cells.

4. A monochromatic image display system as defined in claim 1 in which the cell signal generating means intensity-modulates input signal levels to the respective cells independently of each other.

5. A monochromatic image display system as defined in claim 4, wherein:

there are M cells in each picture element;

there are L tones expressible by intensity modulation of each cell, excluding a zero tone level;

the zero tone level is expressed when the input signals into each of the cells of a respective picture element are turned off; and each picture element has a range of M×L+1 tones, including the zero tone level.

6. A monochromatic image display system as defined in claim 1 in which the cell signal generating means time-modulates input signal levels to the respective cells independently of each other.

7. A monochromatic image display system as defined in claim 6 in which the cell signal generating means time-modulates input signal levels to the respective cells by frame.

8. A monochromatic image display system as defined in claim 7 in which the cell signal generating means determines the output tone level of each cell so that the output luminances of frames are substantially uniform.

9. A monochromatic image display system as defined in claim 7 in which the maximum number of tones which can be expressed by each cell per one frame is not smaller than 64 (6 bits).

10. A monochromatic image display system as defined in claim 6, wherein:

there are M cells in each picture element;

there are N tones expressible by time modulation of each cell, excluding a zero tone level;

the zero tone level is expressed when the input signals into each of the cells of a respective picture element are turned off; and each picture element has a range of M×N1+ tones, including the zero tone level.

11. A monochromatic image display system as defined in claim 1 further comprising a tone number conversion means which carries out a tone number conversion processing on an input original monochromatic image signal, thereby generating said monochromatic image signal, wherein a number of tones represented by said monochromatic image signal is no greater than a number of tones which can be expressed by each respective picture element of said display device.

12. A monochromatic image display system as defined in claim 11 in which the number of tones represented by the original monochromatic image signal is not smaller than 256 (8 bits).

13. A monochromatic image display system as defined in claim 11, wherein a number of tones represented by said input original monochromatic image signal is greater than said number of tones represented by said monochromatic image signal.

14. A monochromatic image display system as defined in claim 1 in which the display device expresses each picture element by three cells.

15. A monochromatic image display system as defined in claim 1 in which the display device is a liquid crystal panel.

16. A monochromatic image display system as defined in claim 1, wherein said display device is further characterized as being a flat panel-like display device, and is further characterized in that the display device is a monochromatic display device which makes a display in said same color which falls within the region surrounded by points (0.174, 0), (0.4, 0.4) and ($\alpha$, 0.4) as represented by co-ordinates (x, y) on a CIE chromaticity diagram, wherein $\alpha$ represents the x-coordinate of the intersection of a spectrum locus and a straight line y32 0.4.

17. A monochromatic image display system as defined in claim 16 in which the display device further comprises at least one of elements including a substrate, a face plate, a diffuser panel, a color filter, a diffuser film, a collimator film, a prism film and a polarizing film which are colored to a predetermined color.

18. A monochromatic image display system as defined in claim 17, wherein said at least one of elements is formed of polyethylene terephthalate colored with an anthraquinone dye to a color of said predetermined color.

19. A monochromatic image display system as defined in claim 16, further comprising at least one of:

an area modulation means which controls the output luminance of each picture element by selectively turning on and off input signals to respective cells, for each picture element, independently of each other, a time modulation means which drives the respective cells for each picture element in a time division system, and an intensity modulation means which controls input signal levels to the respective cells for each picture element independently of each other, wherein the cells are driven so that the maximum luminance of each picture element is in the range of 100 $cd/m^2$ to 10000 $cd^2$.

20. A monochromatic image display system as defined in claim 19 in which the maximum luminance of each picture element is in the range of 500 $cd/m^2$ to 5000 $cd/m^2$.

21. A monochromatic image display system as defined in claim 16 in which the display device is a liquid crystal panel.

22. A monochromatic image display system as defined in claim 16 in which the display device is an organic EL panel.

23. A monochromatic image display system as defined in claim 16, wherein said same color is blue.

24. A monochromatic image display system as defined in claim 1 in which the cell signal generating means intensity-modulates and time-modulates the input signal levels to the respective cells independently of each other.

25. A monochromatic image display system as defined in claim 24, wherein:

there are M cells in each picture element;

there are L tones expressible by intensity modulation of each cell, excluding a zero tone level;

there are N tones expressible by time modulation of each cell, excluding the zero tone level;

the zero tone level is expressed when the input signals into each of the cells of a respective picture element are turned off; and each picture element has a range of $M \times L \times N+1$ tones, including the zero tone level.

26. A monochromatic image display system as defined in claim 1, wherein:

at least two of said series of cells have maximum output levels different from each other; and said cell signal generating means generates the cell signal for each cell so that the output level difference per one level differs from each other between said at least two of said series of cells.

27. A monochromatic image display system as defined in claim 1, wherein said display device is a monochromatic display device which makes a display in said same color which falls within a region surrounded by points (0.174, 0), (0.4, 0.4) and (a, 0.4) as represented by co-ordinates (x, y) on a CW chromaticity diagram, wherein $\alpha$ represents an x-coordinate of an intersection of a spectrum locus with a straight line y=0.4.

28. A monochromatic image display system as defined in claim 27, wherein said same color is blue.

29. A monochromatic image display system comprising:

a display device comprising a plurality of picture elements, each picture element comprising a series of spatially adjacent cells, arranged in a linear manner, each cell emitting light in a same color and expressing tones in three or more levels, and at least two of said series of cells having maximum output levels different from each other; and a drive means which drives the cells of a respective picture element so that the output level difference per one level of said three or more levels differs from each other between said at least two of said series of cells, wherein the plurality of picture elements express a monochromatic image.

30. A monochromatic image display system as defined in claim 29 in which the maximum output level of one of said at least two cells is substantially the same as the output level difference per one level of the other cell.

31. A monochromatic image display system as defined in claim 30 in which the drive means drives the cells so that said at least two cells express tones in substantially the same number of levels.

32. A monochromatic image display system as defined in claim 29 in which the display device is a liquid crystal panel provided with monochromatic filters which are different in transmittance and respectively formed on said at least two cells for each picture element so that the maximum output levels of said at least two cells become different from each other.

33. A monochromatic image display system as defined in claim 29 in which the display device is an organic EL panel in which said at least two cells for each picture element emit light in the same color at different luminances for a given signal level, wherein said given signal level indicates an output luminance of the respective picture element having said at least two cells.

34. A monochromatic image display system comprising:

a display device comprising a plurality of picture elements, each picture element comprising a series of spatially adjacent cells, arranged in a linear manner, each cell emitting light in a same color and expressing tones in three or more levels; and a cell signal generating means which generates, based on a monochromatic image signal indicating an output luminance of each picture element of a monochromatic image, a cell signal for each spatially adjacent cell of a respective picture element of said display device, said cell signal determining an output tone level of the cell, so that an sum of the output luminance of all the cells within each respective picture element correspond to an output luminance of the respective picture element, wherein each respective picture element of said display device corresponds to a picture element of said monochromatic image, and wherein the output luminance of the plurality of picture elements of said display device express said monochromatic image.

* * * * *